US006739591B2

(12) United States Patent
Chujo et al.

(10) Patent No.: US 6,739,591 B2
(45) Date of Patent: May 25, 2004

(54) SHEET DOUBLE FEEDING DETECTOR, METHOD AND PROGRAM OF SUCH A DEVICE

(75) Inventors: Hideki Chujo, Kyoto (JP); Keitaro Taniguchi, Kyoto (JP); Tomohiro Inoue, Kyoto (JP)

(73) Assignee: Omron Corporation, Kyoto (JP)

( * ) Notice: Subject to any disclaimer, the term of this patent is extended or adjusted under 35 U.S.C. 154(b) by 60 days.

(21) Appl. No.: 10/172,495

(22) Filed: Jun. 17, 2002

(65) Prior Publication Data

US 2003/0006550 A1 Jan. 9, 2003

(30) Foreign Application Priority Data

Jun. 15, 2001 (JP) ..... 2001-181550
Oct. 2, 2001 (JP) ..... 2001-306065
Nov. 9, 2001 (JP) ..... 2001-344330

(51) Int. Cl.[7] ..... B65H 7/02

(52) U.S. Cl. ..... 271/262; 271/263; 271/265.04; 73/1.81

(58) Field of Search ..... 271/262, 263, 271/265.04, 3.15, 4.02, 10.02, 258.01; 73/1.81; 324/229, 635, 644, 662, 671, 691, 716; 101/73; B65H 7/02, 5/00, 5/22, 83/00, 85/00, 7/12

(56) References Cited

U.S. PATENT DOCUMENTS 4,237,378 A * 12/1980 Jones ..... 250/223 R
4,462,587 A * 7/1984 Graef et al. ..... 271/263
5,623,307 A * 4/1997 Kotidis et al. ..... 356/493
6,520,498 B2 * 2/2003 Phinney ..... 271/263

FOREIGN PATENT DOCUMENTS

EP 1 022 243 A2 * 7/2000 ..... B65H/7/06

* cited by examiner

*Primary Examiner*—Donald P. Walsh
*Assistant Examiner*—Kenneth W Bower
(74) *Attorney, Agent, or Firm*—Morrison & Foerster LLP

(57) ABSTRACT

An ultrasonic wave receiver receives an ultrasonic wave outputted by an ultrasonic wave oscillator, and outputs a receiving signal. A level determining unit makes a determination as to the presence or absence of a sheet of paper based upon a level of the receiving signal. A CPU is informed of this determining signal through a processing unit. An oscillation peak detector detects a peak value of a transmission signal used for controlling an ultrasonic wave transmitter, which is transmitted from an oscillation amplifier. A receiving peak detector detects a peak value of the receiving signal received by the ultrasonic transmitter. The phase difference of the two signals is detected based upon the difference in count values of a loop counter between the timing in which the peak value of the transmission signal is detected and the timing in which the peak value of the receiving signal is detected. The number of times in which the phase difference has exceeded a predetermined range is counted by a determining counter, and when the count value exceeds a reference value, it is determined that a plurality of sheets of paper are superimposed. Thus, it becomes possible to positively detect a doubles feeding of sheets.

31 Claims, 28 Drawing Sheets

[Fig. 1]
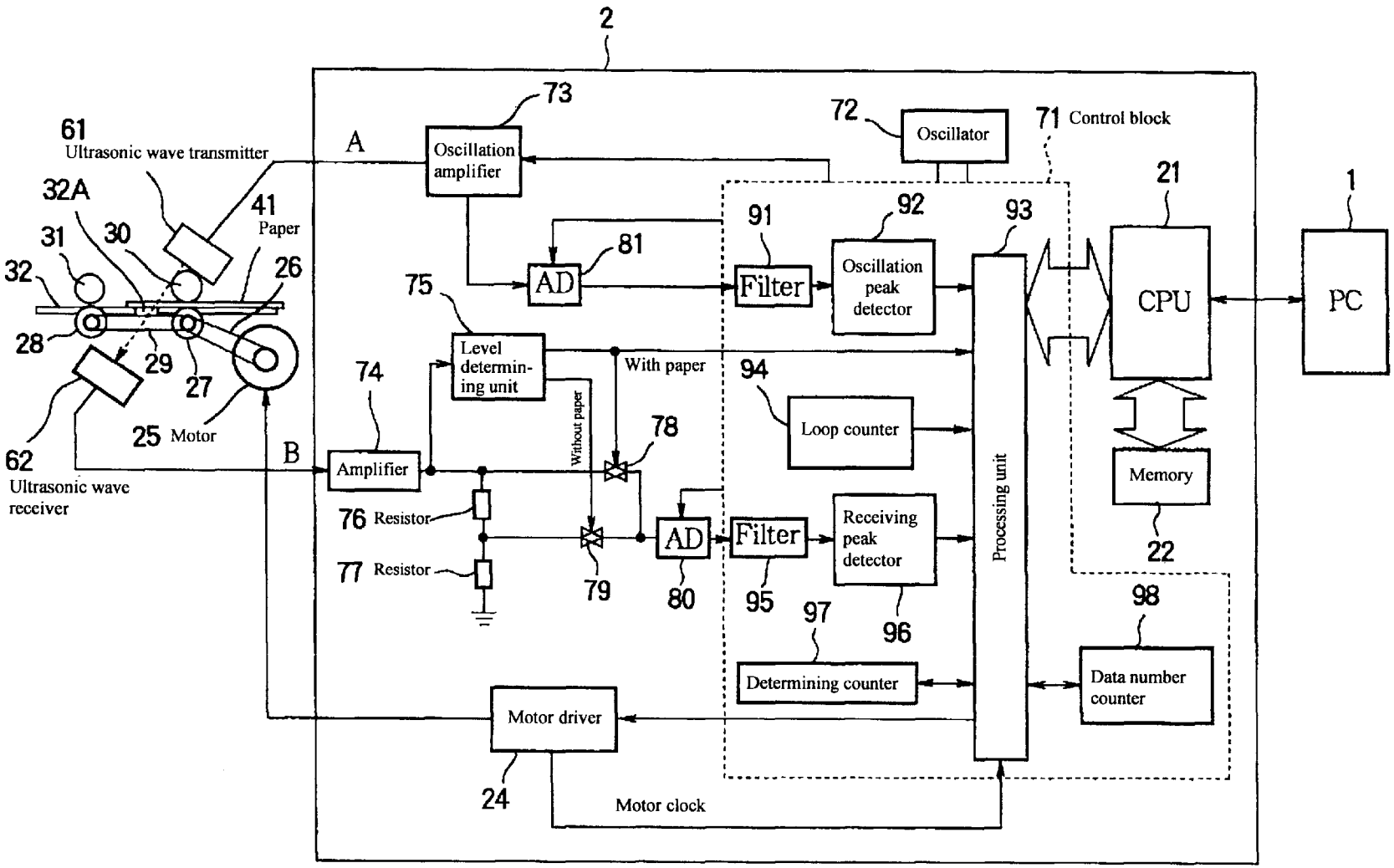

[Fig. 2]
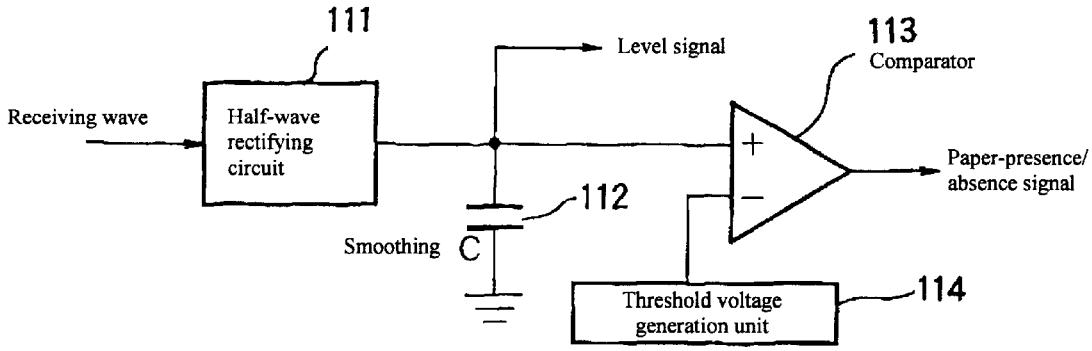
75 Level determination unit

[Fig. 3]
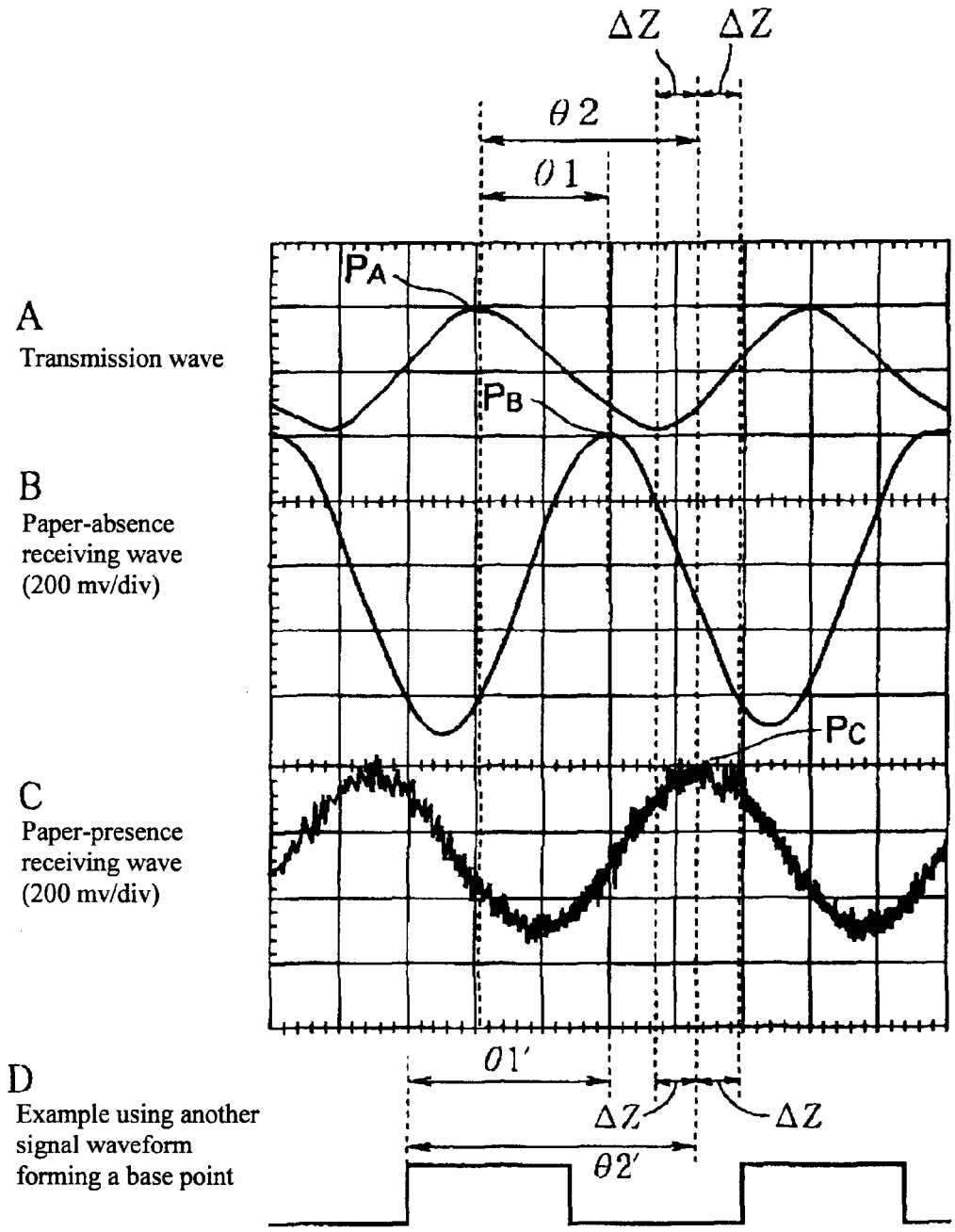

[Fig. 4]
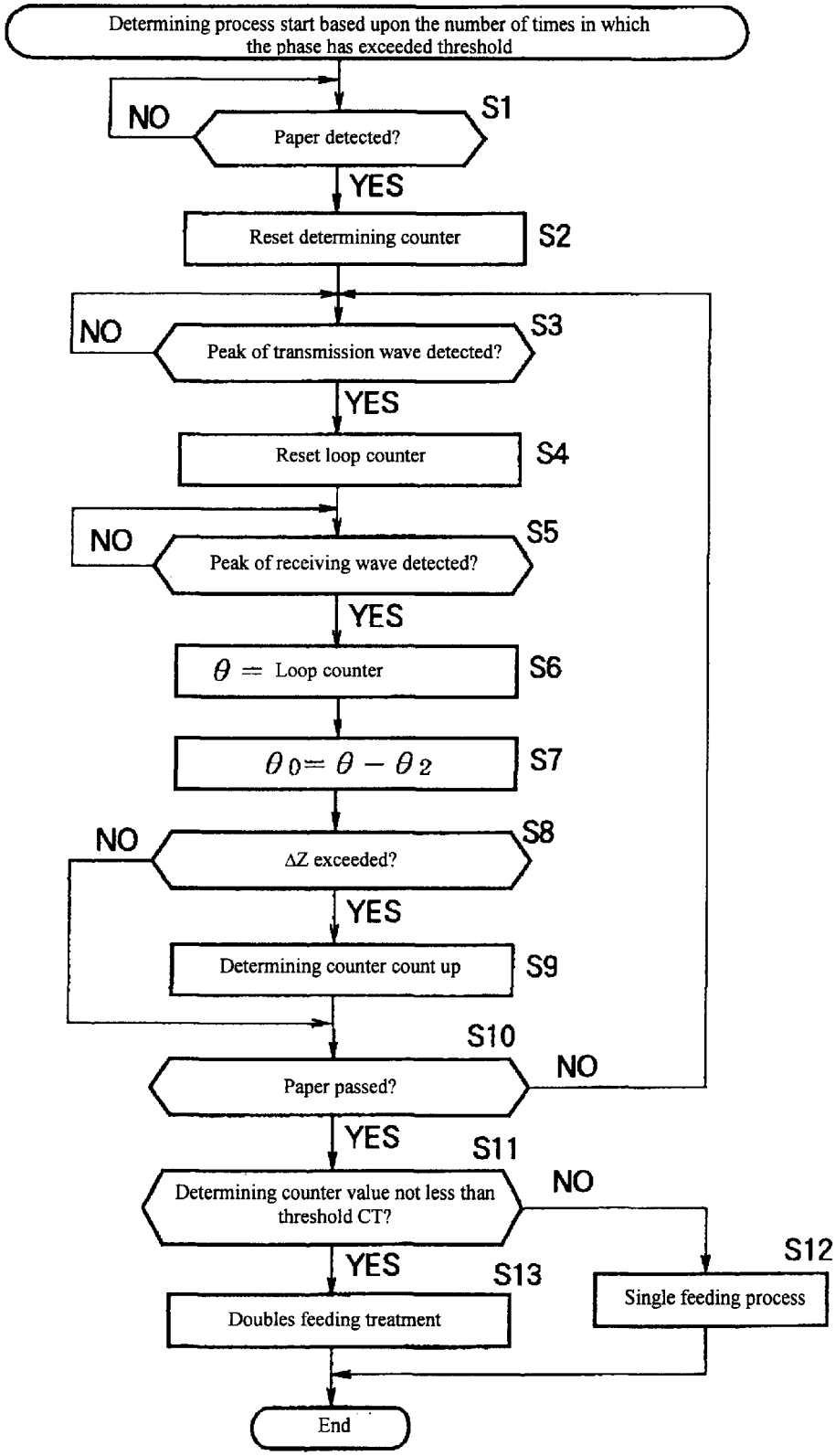

[Fig. 5]
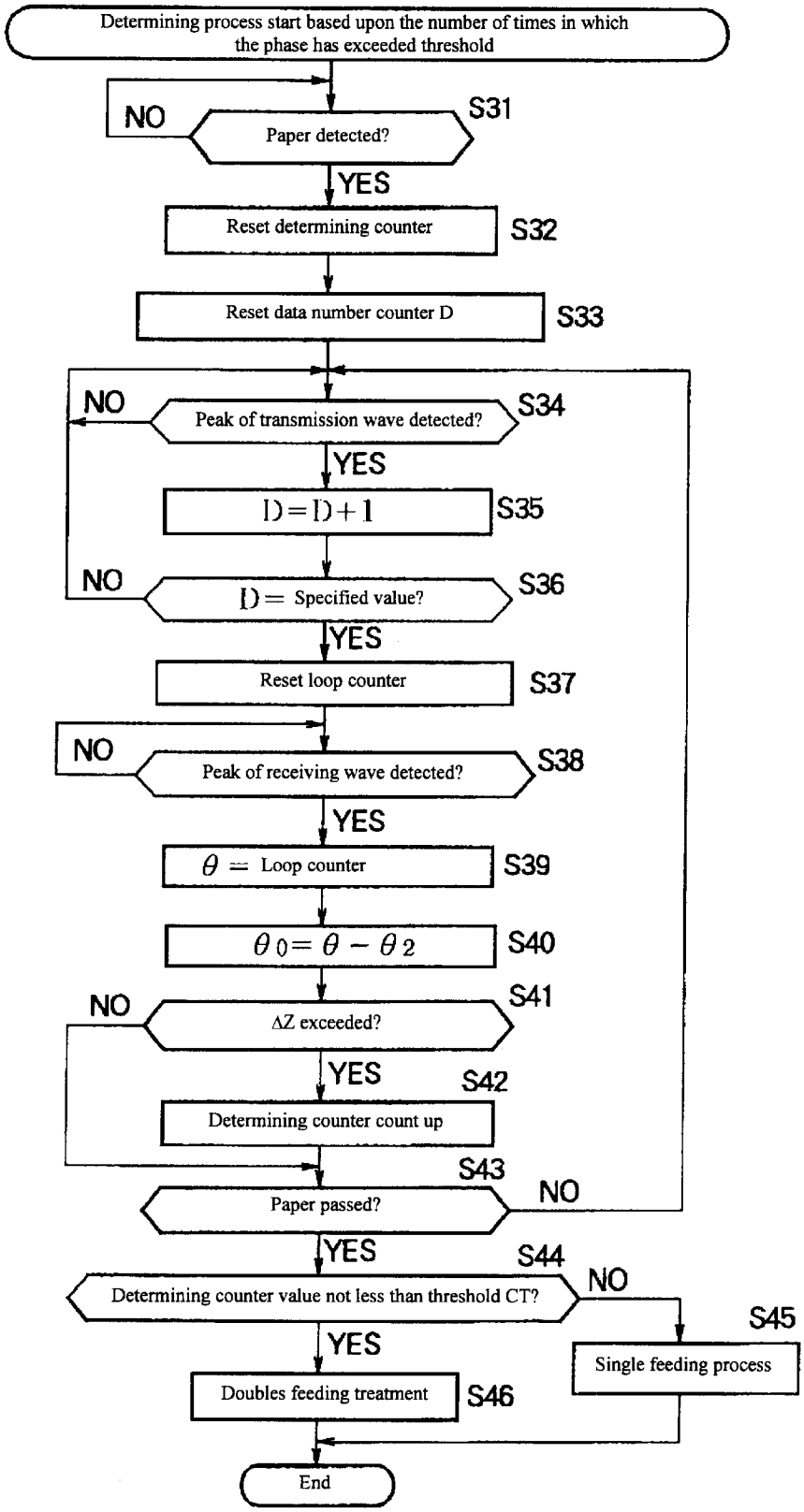

[Fig. 6]
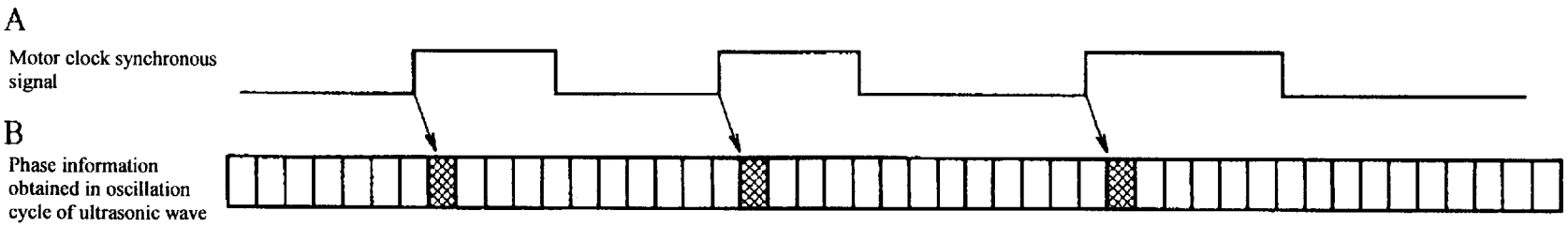

[Fig. 7]
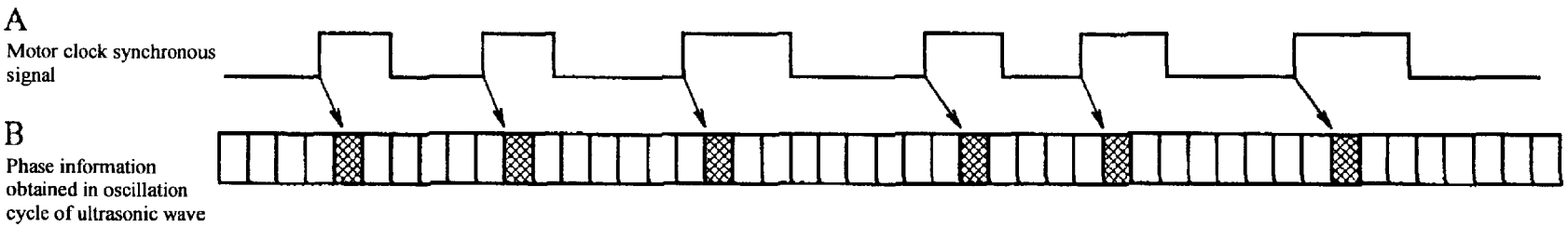

[Fig. 8]
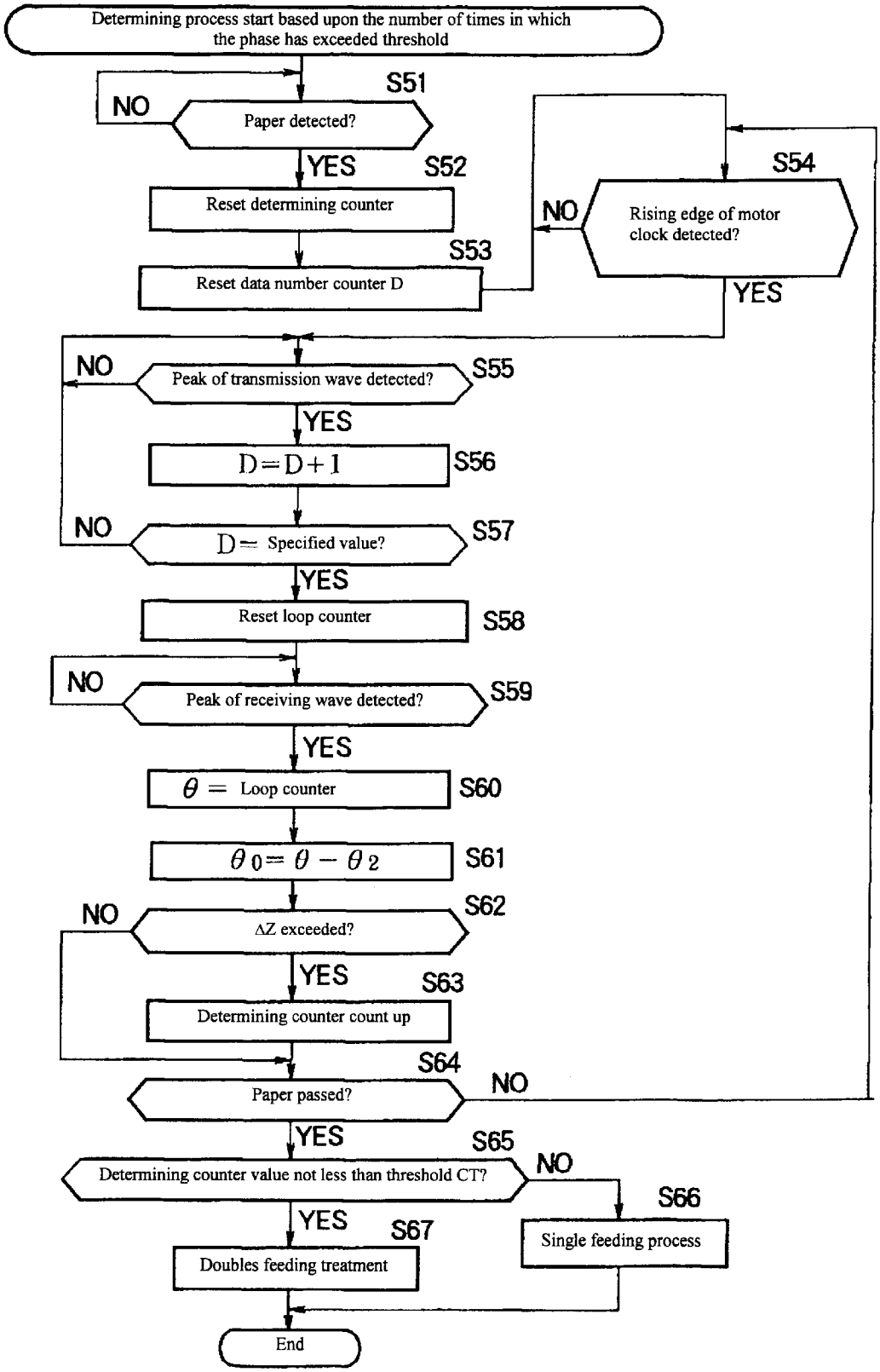

[Fig. 9]
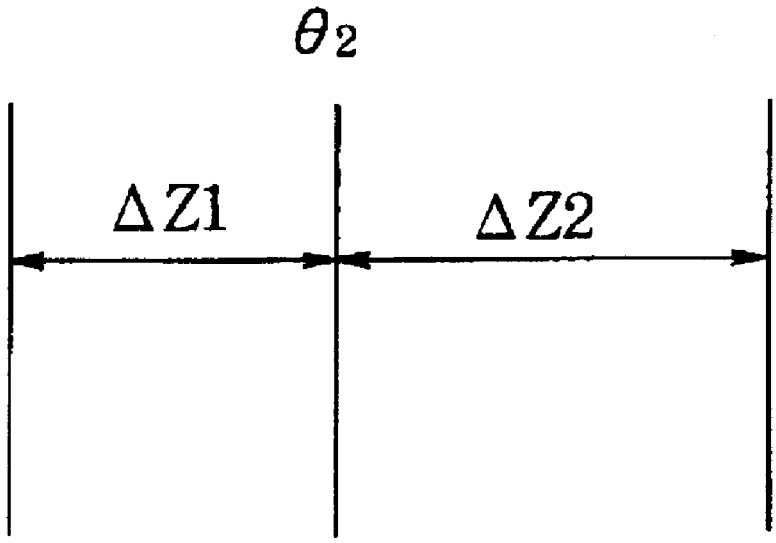

[Fig. 10]
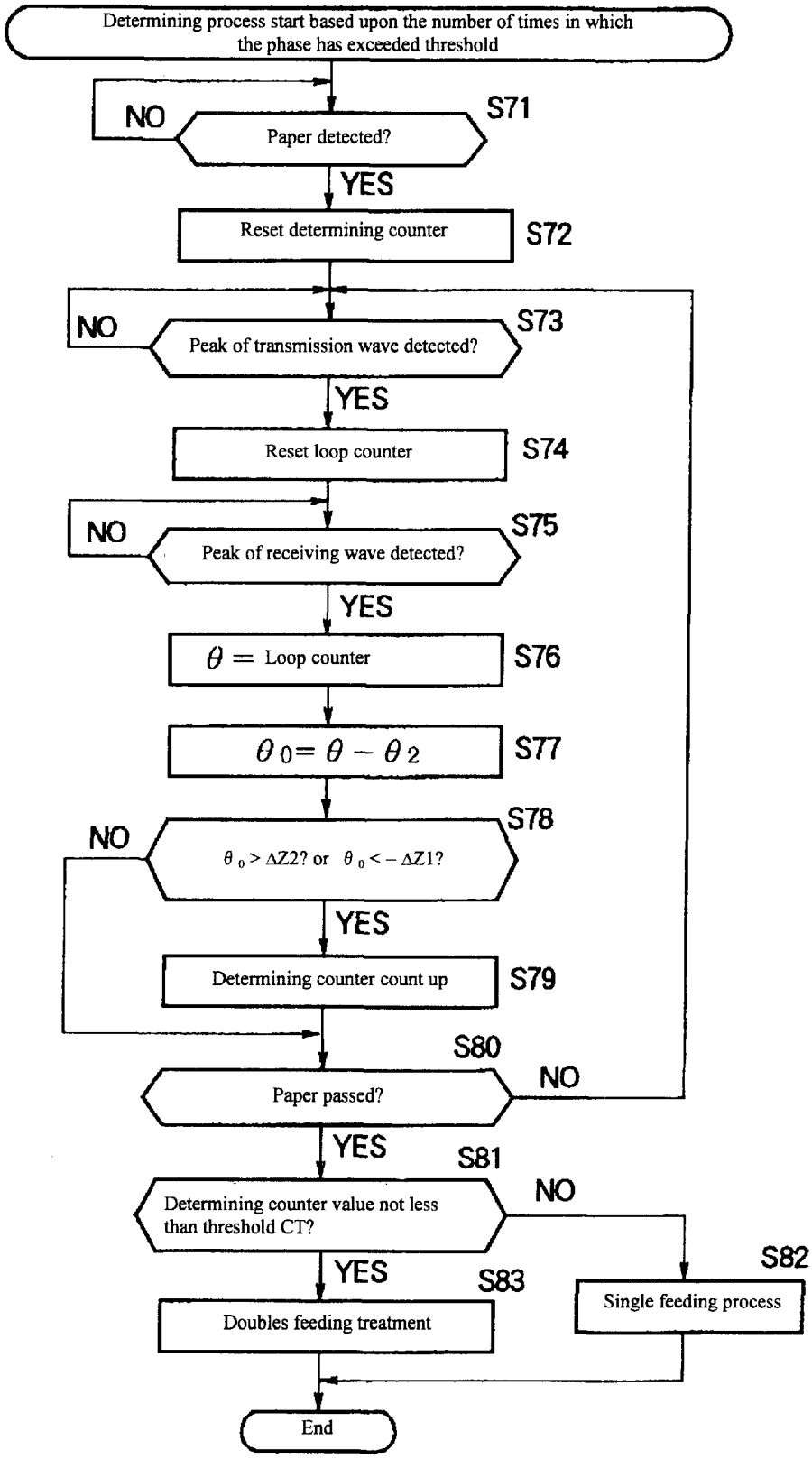

[Fig. 11]
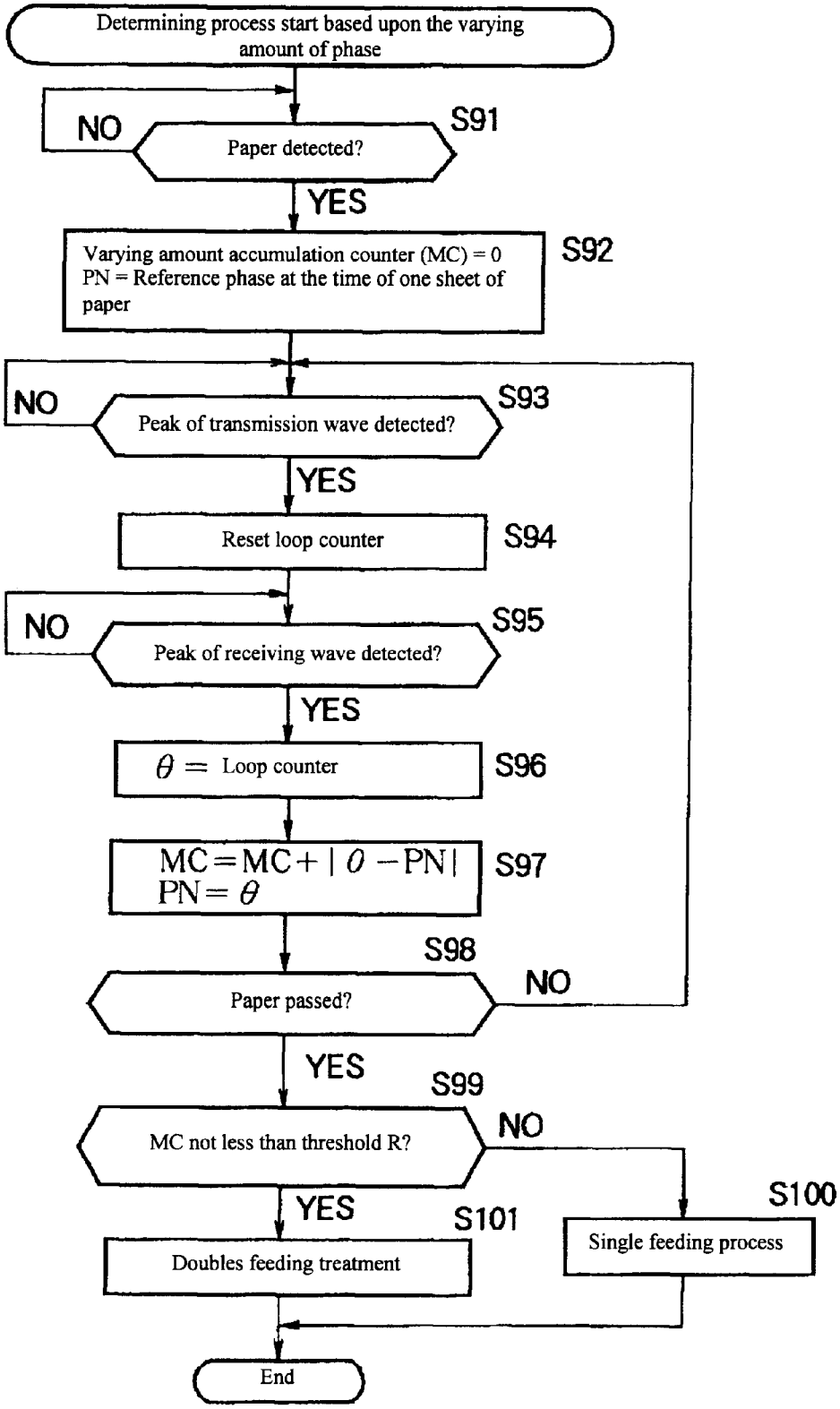

[Fig. 12]
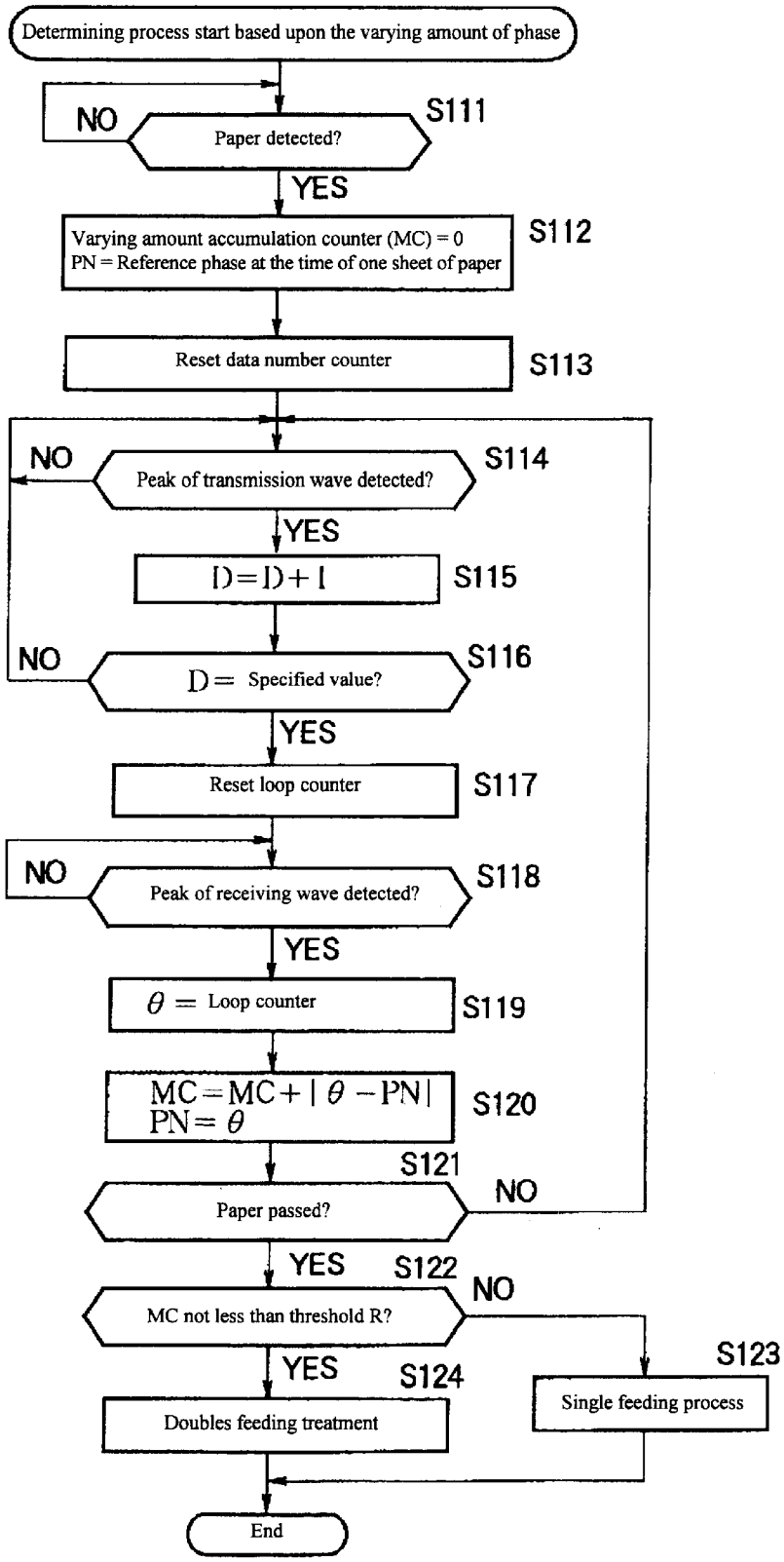

[Fig. 13]
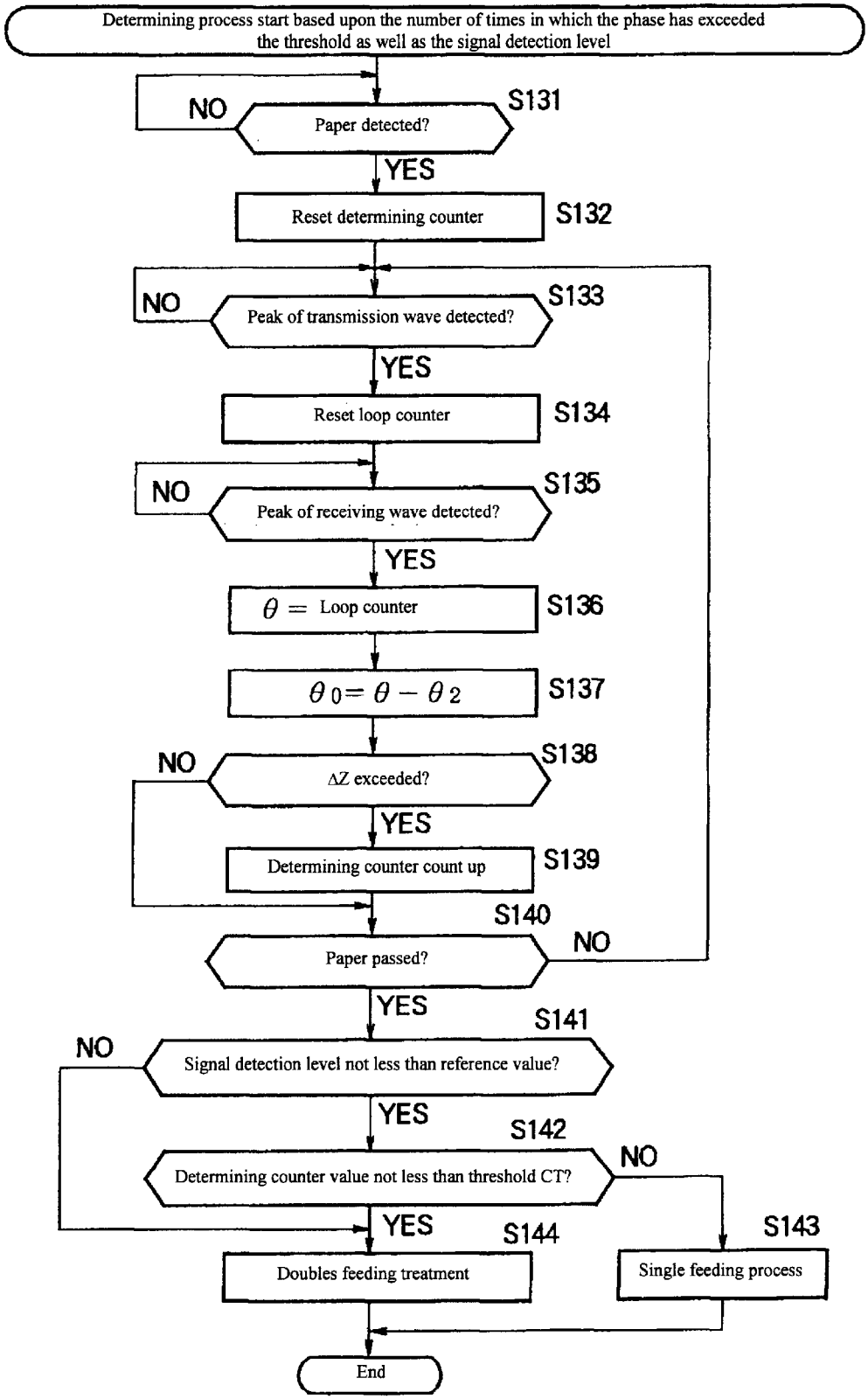

[Fig. 14]
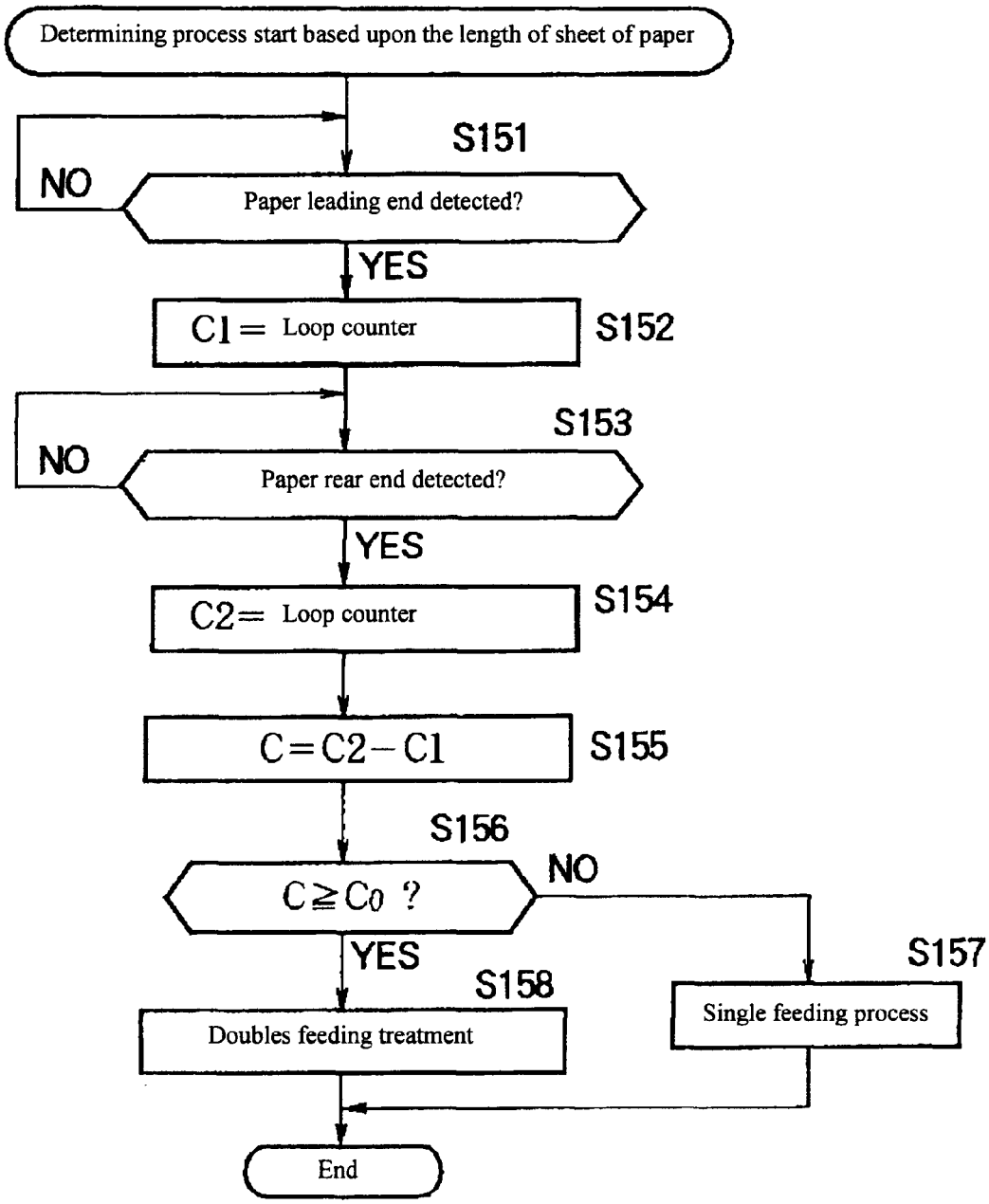

[Fig. 15]
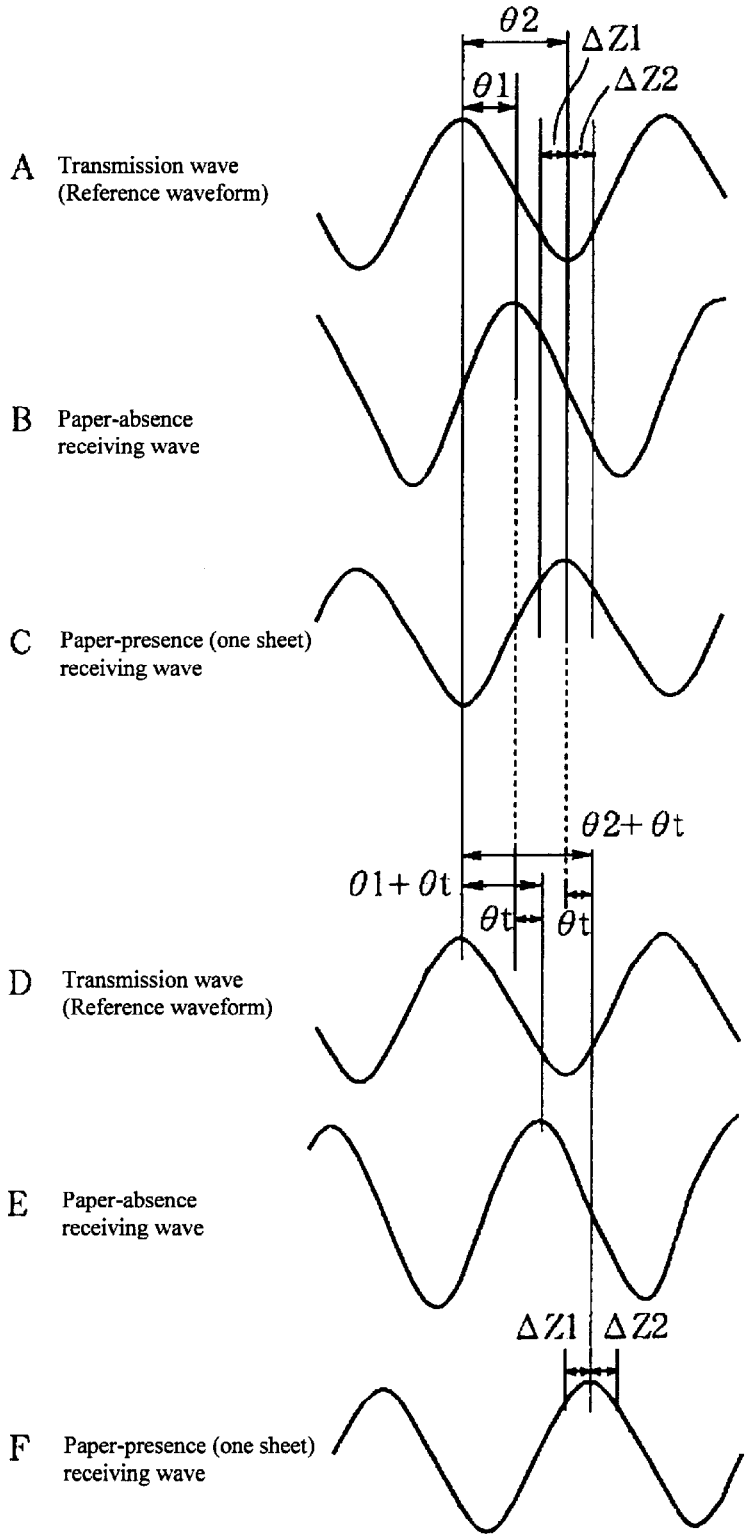

[Fig. 16]
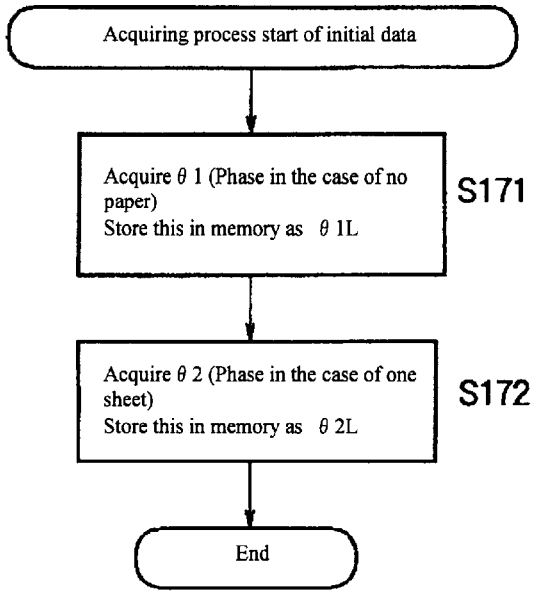
[Fig. 17]
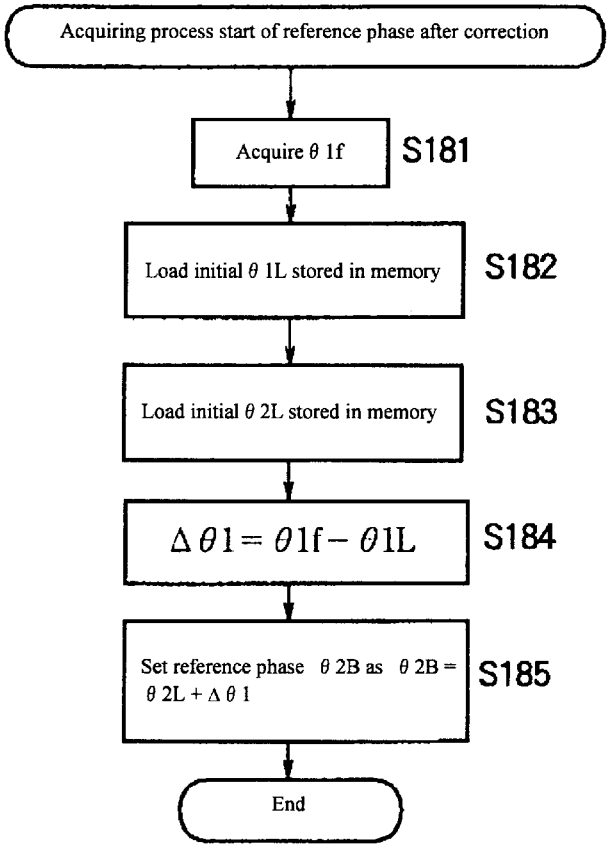

[Fig. 18]
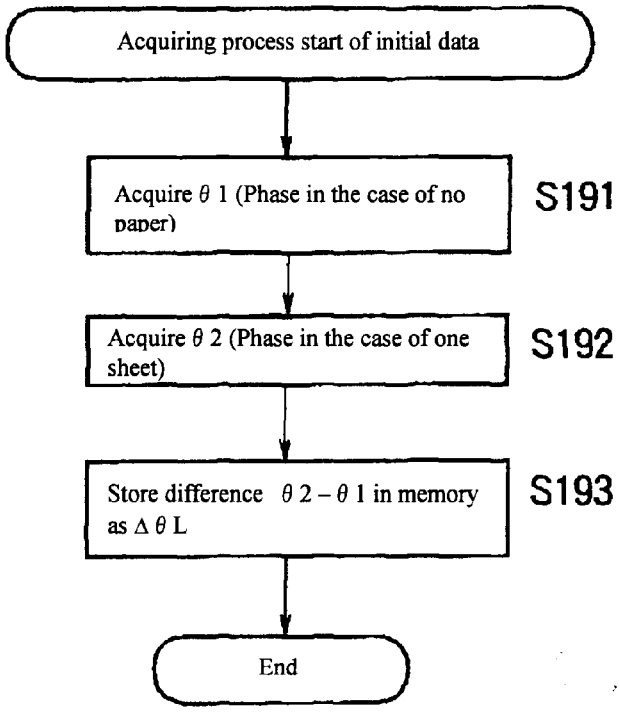
[Fig. 19]
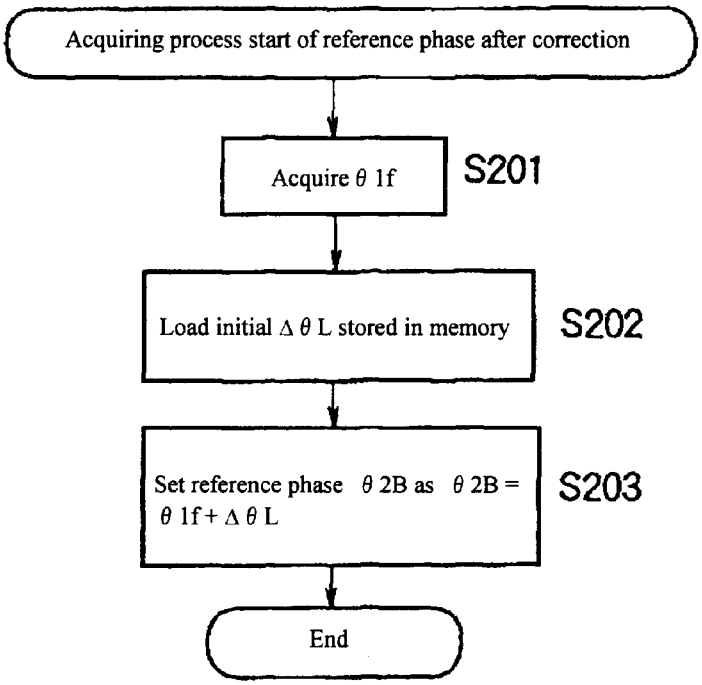

[Fig. 20]
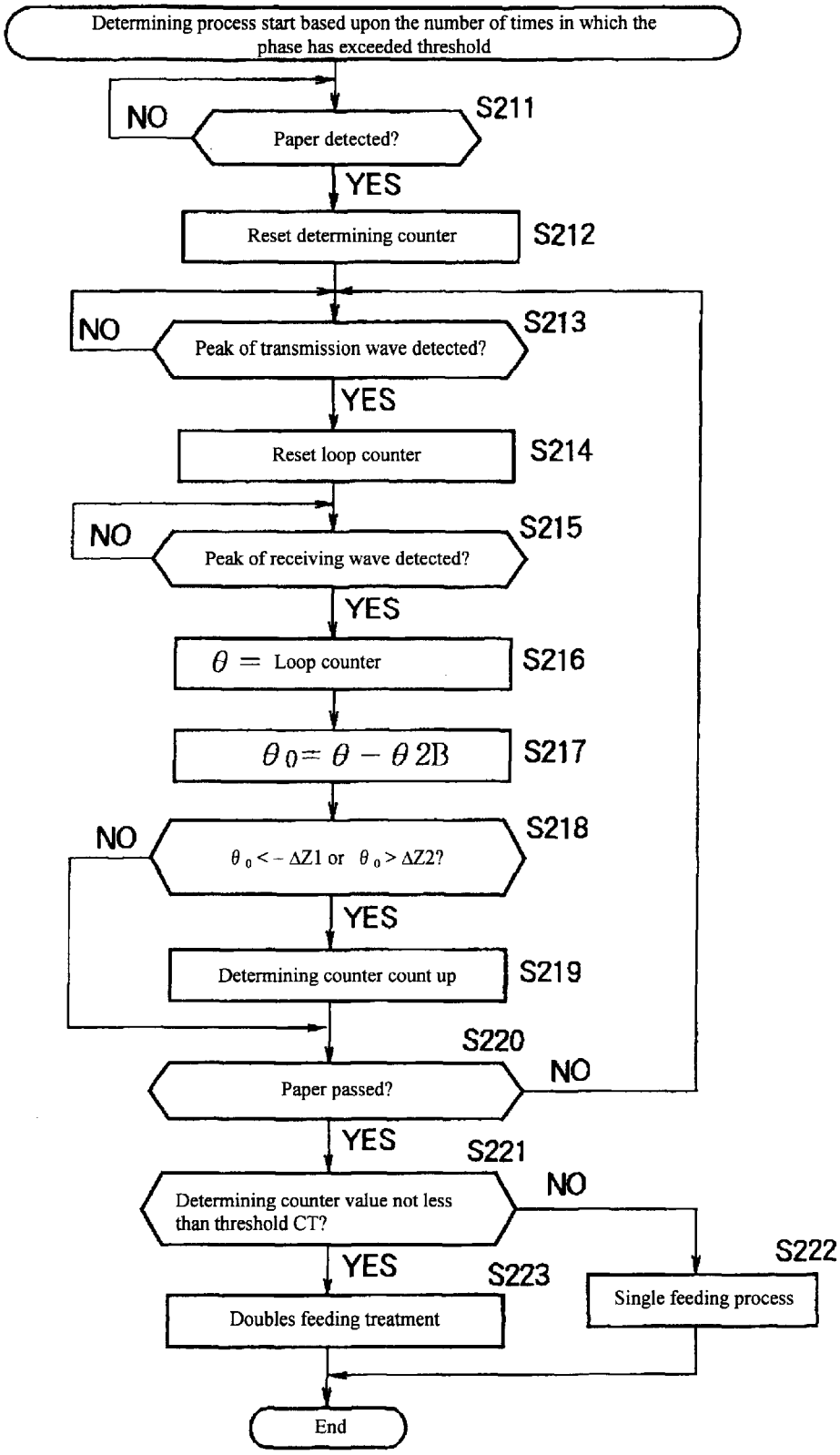

[Fig. 21]
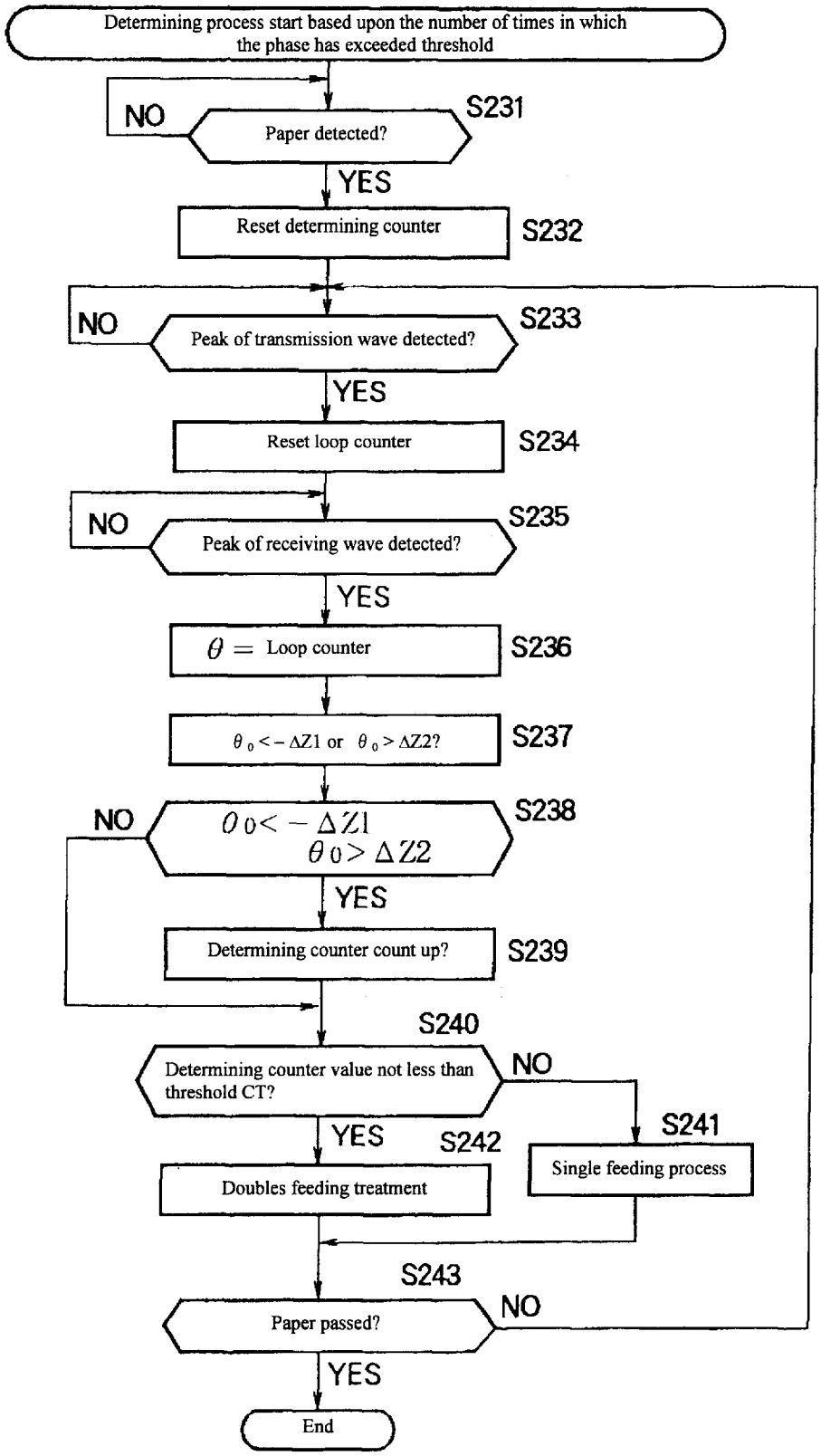

[Fig. 22]
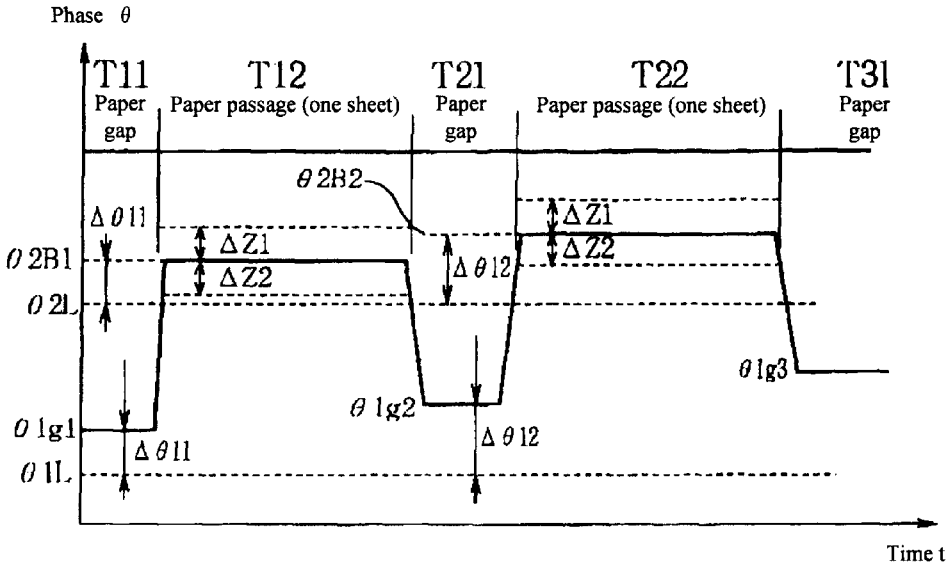
[Fig. 23]
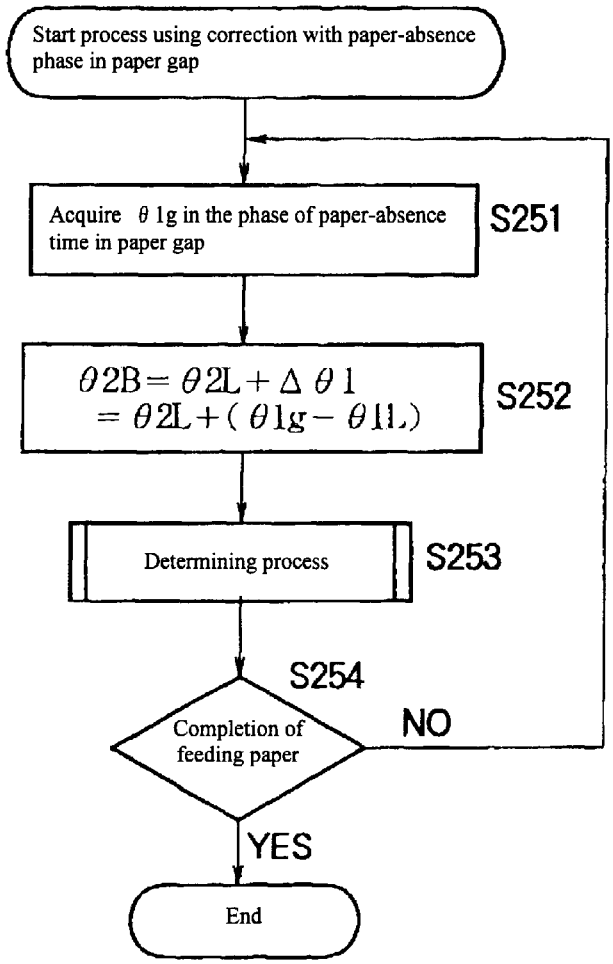

[Fig. 24]
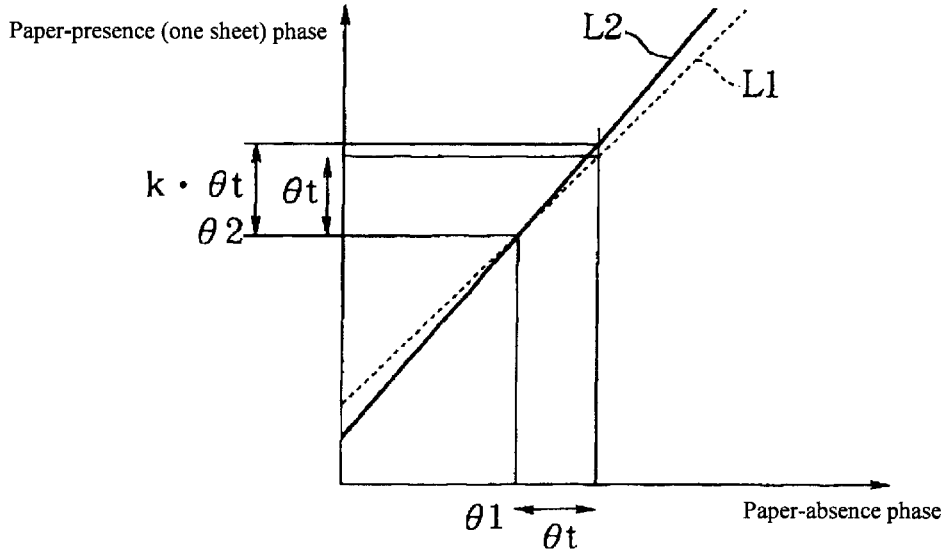
[Fig. 25]
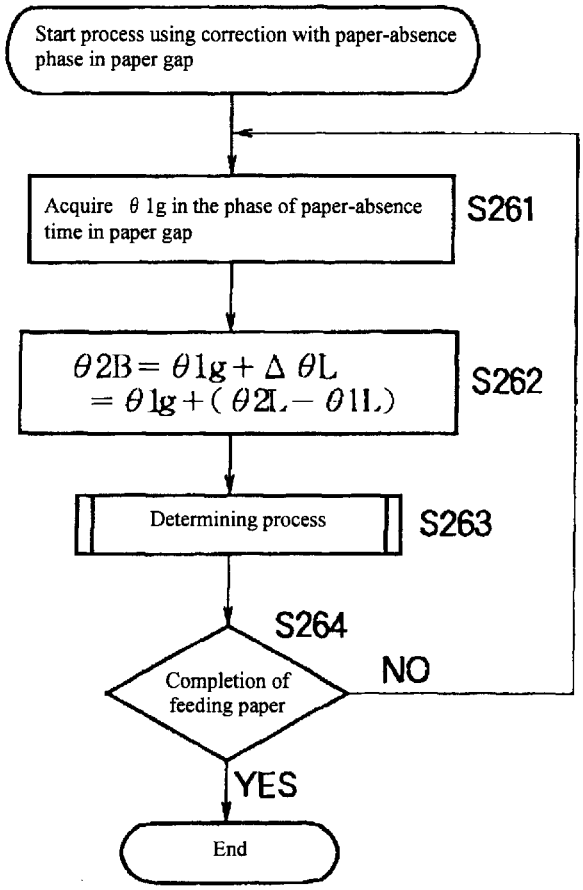

[Fig. 26]
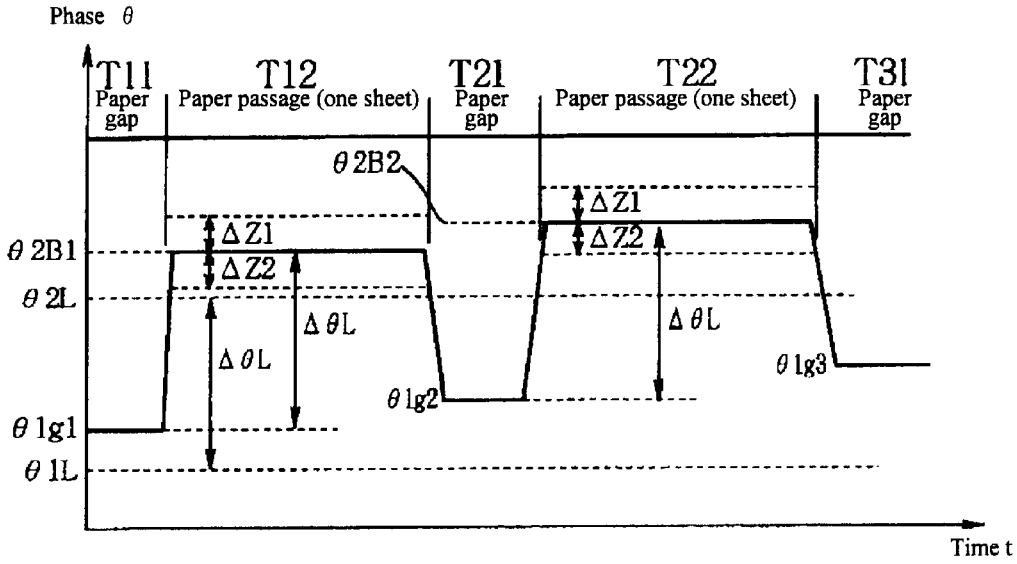
[Fig. 27]
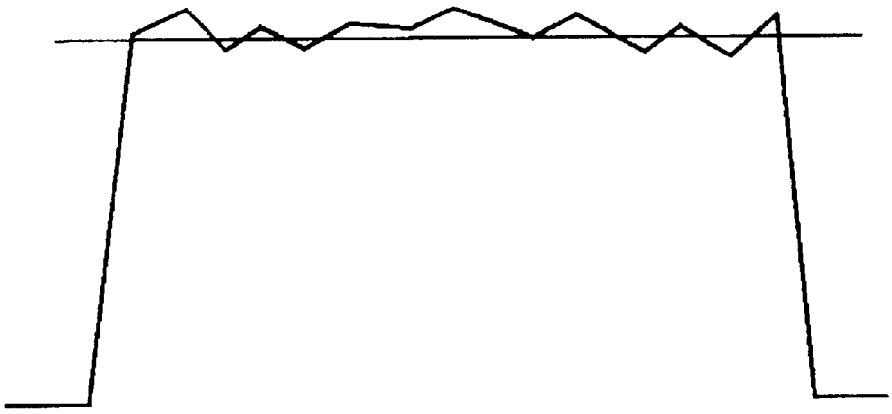

[Fig. 28]
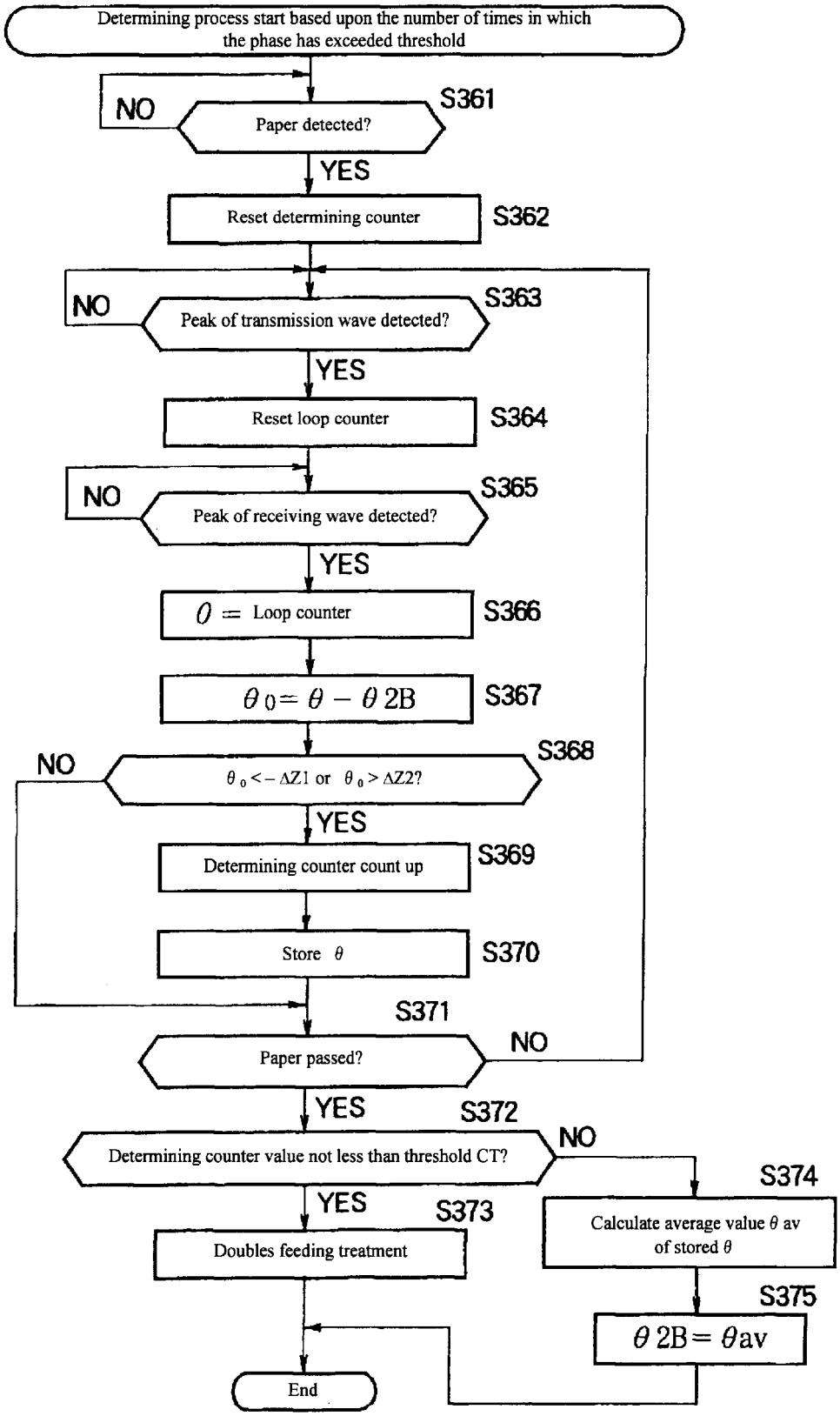

[Fig. 29]
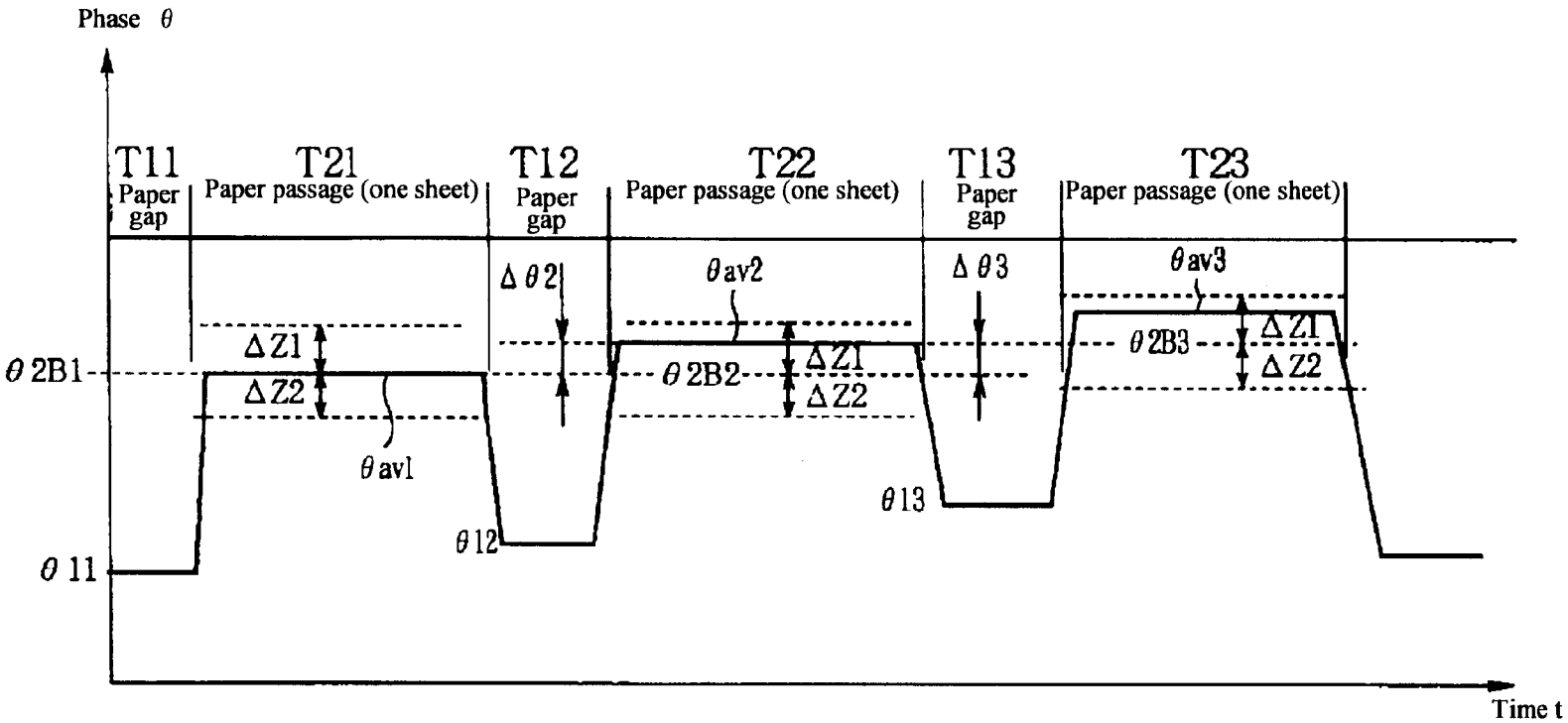

[Fig. 30]
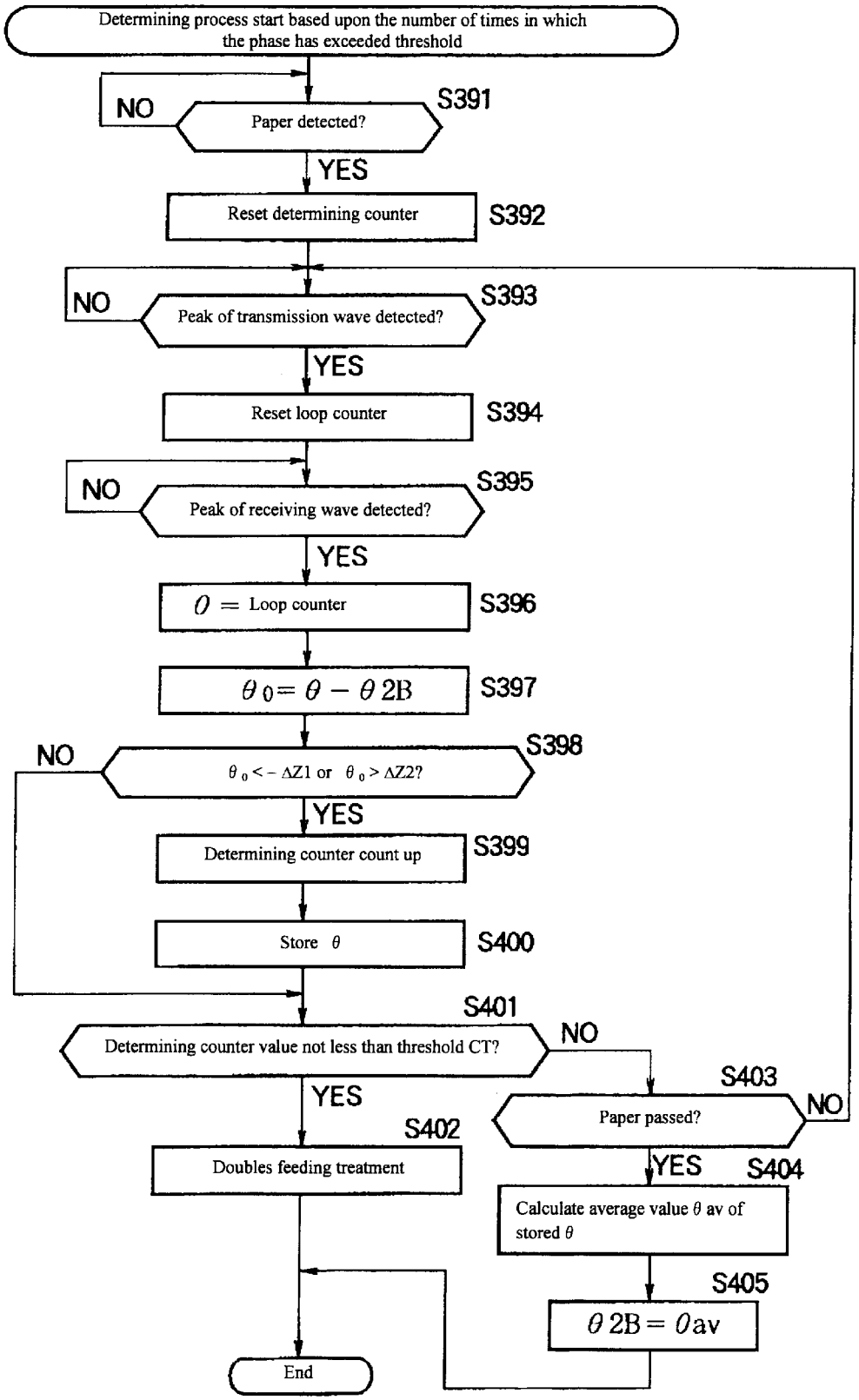

[Fig. 31]
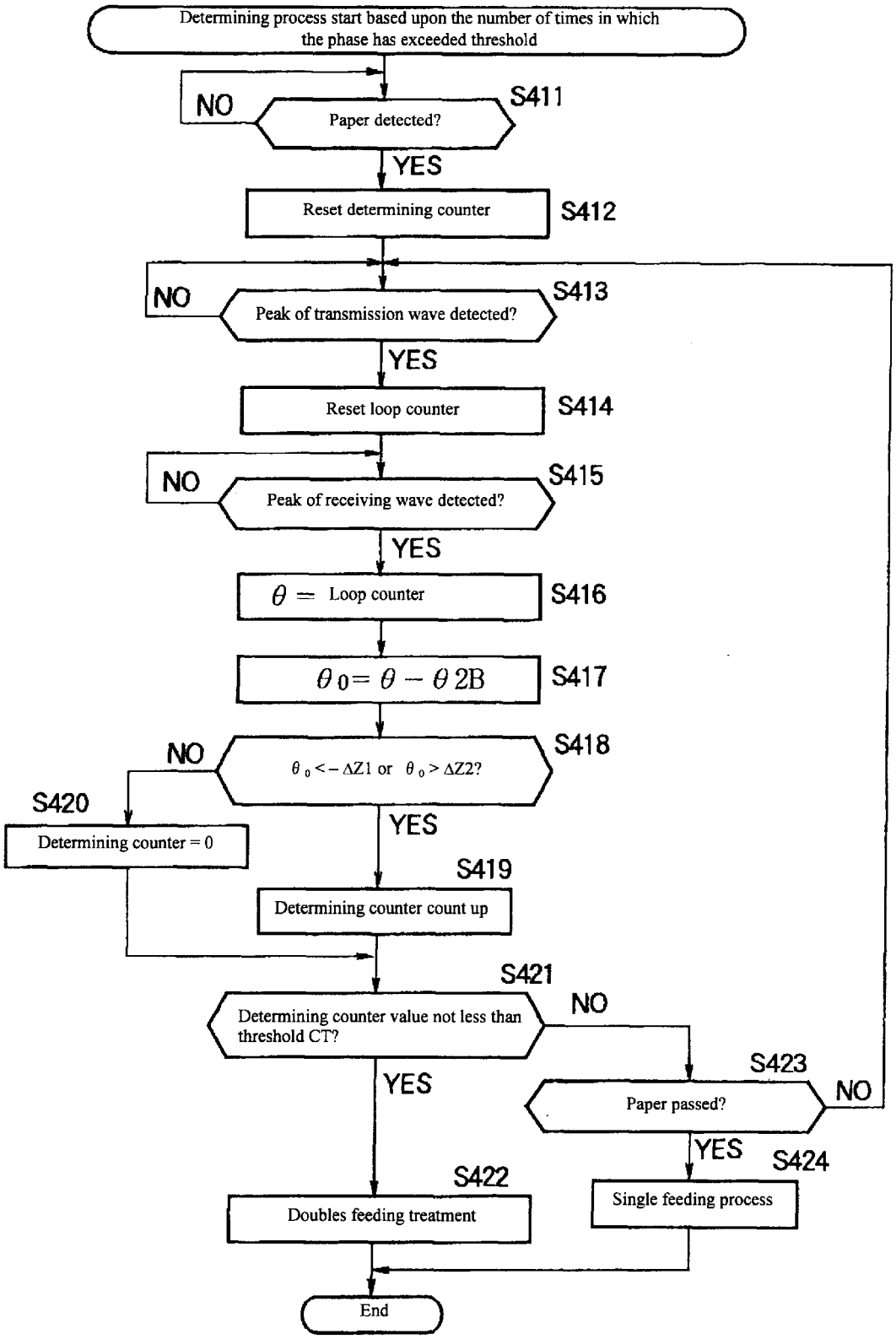

[Fig. 32]
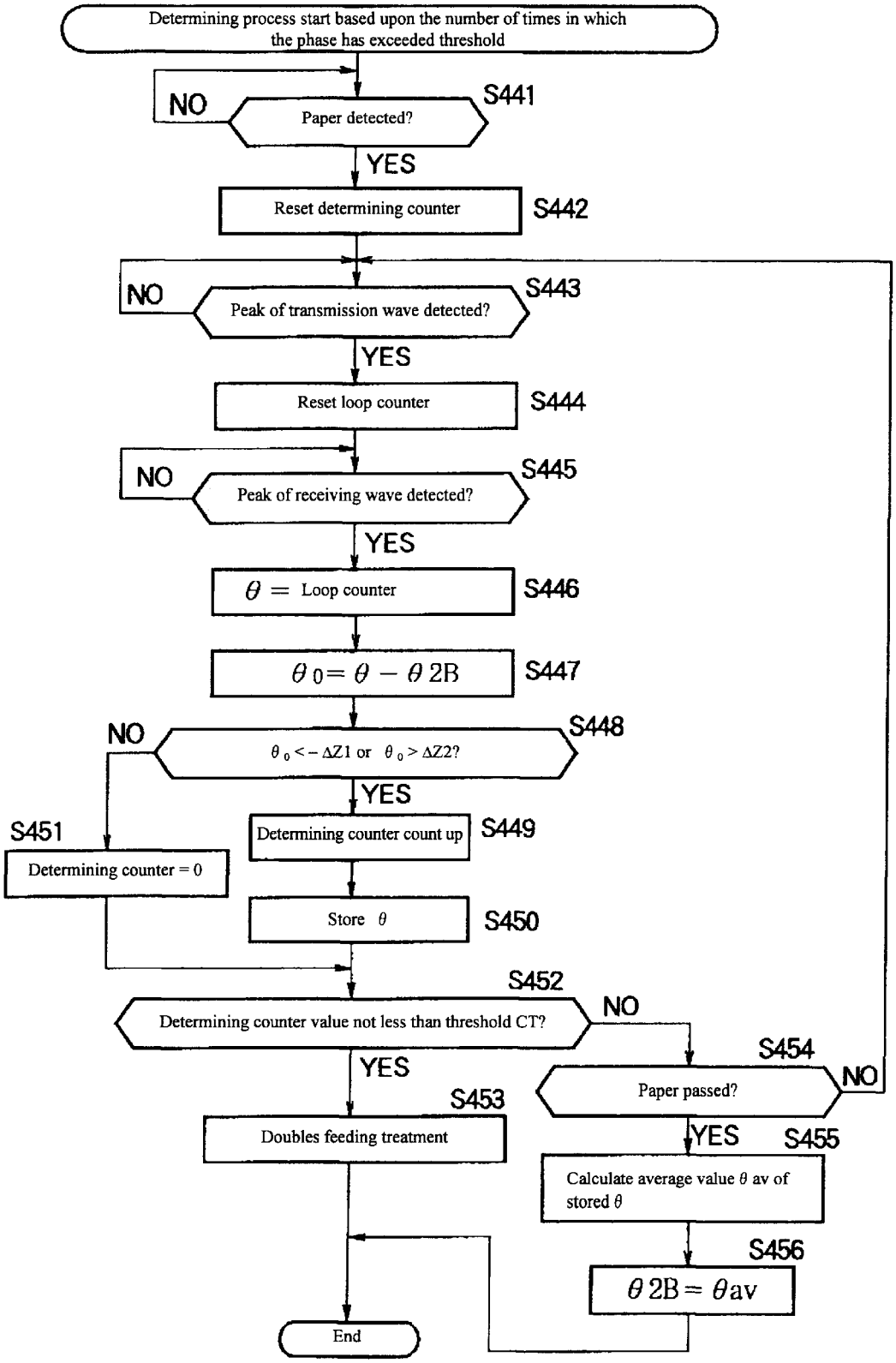

[Fig. 33]
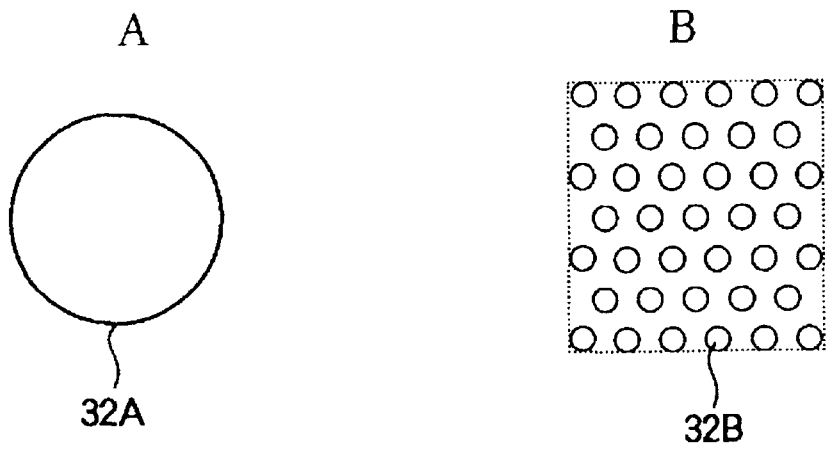
[FIG. 34]
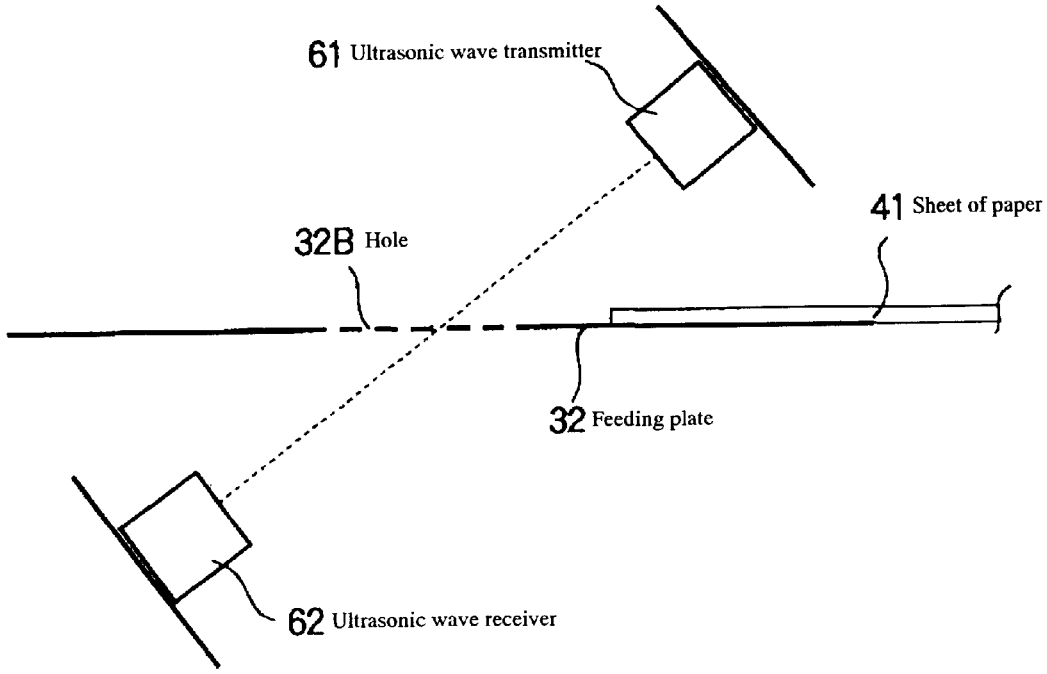

SHEET DOUBLE FEEDING DETECTOR, METHOD AND PROGRAM OF SUCH A DEVICE

BACKGROUND OF THE INVENTION

1. Field of the Invention

The present invention relates to a double sheet feeding detector, a method for detecting double feeding of sheets and a computer program for controlling such a detector, and in particular, concerns a double sheet feeding detector which can more positively detect double feeding of sheets and such a method and a program.

2. Description of the Related Art

When a sheet of paper is fed in a printer, double feeding occurs in the case where two or more sheets are simultaneously fed with at least one portion of one sheet being partially superimposed on another. When such double feeding occurs, it is not possible to carry out a proper printing process. Therefore, in the case where two or more sheets are simultaneously fed, it is necessary to detect this as a double feeding and to temporarily suspend the feeding process.

Conventionally, methods in which ultrasonic waves are used to detect double feeding have been disclosed in Japanese Patent No. 1725105 and JP-A-52-40379.

In Japanese Patent No. 1725105, ultrasonic waves that have been transmitted through sheets are received, and the receiving level is detected. Since there is a difference in the level of the received ultrasonic waves between one sheet of paper and two or more sheets that have been fed, double feeding is detected based upon the difference.

Moreover, as disclosed by JP-A-52-40379, the phase of an ultrasonic wave that has been transmitted through sheets is detected. Since there is a difference in the phase thereof between one sheet of paper and two or more sheets that have been fed, double feeding is detected based upon the phase.

Here, the applicant of the present application has proposed a detecting method in Japanese Patent Application No. 11-13257, in which double feeding is detected by comparing the phases of the receiving signal of an ultrasonic wave and a reference signal, and further comparing a signal corresponding to the phase difference with a reference level.

However, in Japanese Patent No. 1725105, double feeding is detected based upon the receiving level of ultrasonic waves; therefore, in the case when a sheet of paper is thin, there is not much difference in the levels of the received ultrasonic wave signals between one sheet of paper and two or more sheets that have been fed, and it is not possible to detect double feeding correctly.

Moreover, in JP-A-52-40379, in which double feeding is detected based upon the phase of a received ultrasonic signal, when a number of sheets of paper are fed at once, the level of the receiving signal is extremely attenuated, making it impossible to accurately detect the phase of a received signal, and resulting in a failure to accurately detect double feeding.

Furthermore, in the method disclosed in Japanese Patent Application No. 11-13257, since it is necessary to generate a reference signal, a complex process is required in cases when determining conditions, etc. are altered.

SUMMARY OF THE INVENTION

The present invention has been devised to solve the above-mentioned problems and to positively detect double feeding independent of the thickness of sheets, and also to easily set determination conditions.

A first double sheet feeding detector of the present invention is provided with: ultrasonic wave generation means for generating ultrasonic waves to be applied to a feeding path for sheets; ultrasonic wave receiving means for receiving ultrasonic waves generated by said ultrasonic wave generation means; phase-difference detection means which detects a phase difference between a phase of the ultrasonic waves received by the ultrasonic wave receiving means and a predetermined reference phase; comparison means which compares the phase difference detected by the phase-difference detection means with a predetermined first reference value that has been preliminarily set; counting means which counts the number of times of cases in which the phase difference, as detected by the phase-difference detection means, exceeds the first reference value based upon the results of comparison of the comparison means; and double feeding detection means which compares the calculated value counted by the counting means with a second reference value that has been preliminarily set, and detects a double feeding of the sheet based upon the results of this comparison.

In this double sheet feeding detector, the number of times of cases in which the phase difference of the received ultrasonic waves from a predetermined reference phase exceeds the first reference value is counted, and a double feeding of sheets is detected based upon the results of comparison between the counted value and the second reference value. Therefore, it is possible to positively detect double feeding independent of the thickness of sheets. Here, the reference phase refers to a phase of a preliminarily set receiving waves that corresponds to the receiving waves obtained when one sheet is being fed.

In particular, since it is not necessary to generate a reference signal to be compared with the received ultrasonic waves, it is not necessary to set and adjust a reference signal so as to detect a double feeding, thereby making it possible to improve the operability.

For example, sheets are made of paper. The ultrasonic wave generating means is provided as an ultrasonic wave transmitter, and the ultrasonic wave receiving means is provided as an ultrasonic wave receiver.

The preliminarily set reference phase of a received ultrasonic wave is digitized as a phase difference with the peak timing of the transmission waves being set as a base point (phase=0). Moreover, the phase of the receiving waves is also measured with the peak timing of the transmission waves being set as a base point (phase=0).

The phase difference detection means may be provided as a CPU.

The counting means may be provided as a determining counter.

The double feeding detection means may be provided as a CPU.

With respect to the first reference value, the comparison means may have at least either a third reference value serving as a reference with respect to the deviation of the phase difference in the positive direction or a fourth reference value having an absolute value different from the third reference value and serving as a reference with respect to the deviation of the phase difference in the negative direction.

The third reference value is formed by, for example, $\Delta Z2$ shown in FIG. 9, and the fourth reference value is formed by $\Delta Z_1$.

In this manner, by setting the reference values in the positive direction and negative direction as different values, it is impossible to more positively detect double feeding of sheets in response to inherent conditions of respective devices for feeding sheets.

The double feeding detection means may alter the second reference value in accordance with the feeding speed or the size (length) of the sheets.

The second reference value may be set as a small value when the feeding speed of sheets is great, and also set as a great value when the size of sheets is great (the length thereof is long).

In this manner, by altering the second reference value dynamically in accordance with the feeding speed and the size of the sheets, it becomes possible to more positively detect double feeding.

The count number per unit time by the above-mentioned counting means may be altered in accordance with the feeding speed or the size of the sheets.

Thus, it becomes possible to positively detect double feeding.

A feeding means for feeding sheets onto a feeding path may be further placed so that the phase-difference detection means is allowed to detect a phase difference from the reference phase of ultrasonic waves received by the ultrasonic wave receiving means, in synchronism with a motor driving signal.

The feeding means for feeding sheets may be formed by, for example, a motor driver for driving a motor. The signal synchronizing to the feeding amount is formed by, for example, a motor clock synchronous signal.

Thus, even in the case when the feeding speed of sheets is changed in the middle of the feeding process, it is possible to always maintain a predetermined number of phase-difference detections (sampling) with respect to sheets having the same length.

A speed control means, which controls the feeding speed of sheets so as to make the feeding speed of sheets at the time of determination of a double feeding slower than determinations other than double feeding, may be further placed.

The speed control means may be provided by, for example, a motor driver.

By making the feeding speed of sheets at the time of determination of a double feeding slower, it becomes possible to detect a double feeding more accurately.

A level detection means for detecting the level of ultrasonic waves received by the above-mentioned ultrasonic wave receiving means may be further installed, and based upon the results of detection by the level detection means, the double feeding detection means makes it possible to detect a case in which the level of the ultrasonic waves is smaller than the reference value, thus detecting double feeding independent of values of the counted value.

With this arrangement, which is based upon the results of detection by the level detection means, it is possible to detect a case in which the level of ultrasonic waves is smaller than the reference value, thus detecting double feeding independent of values of the counted value; therefore, even when the level of the ultrasonic waves becomes extremely low due to a feeding of a number of sheets at the same time, it becomes possible to accurately detect double feeding.

Moreover, a sheet detection means for detecting the presence or absence of sheets by using the level of a received signal may be further installed.

The sheet detection means may be provided as, for example, a level determining unit.

A level control means, which controls the level of the signal received by the ultrasonic wave receiving means based upon the results of detection by the above-mentioned sheet detection means, may be further installed.

The level control means may be constituted by, for example, analog switches and resistors.

By controlling the level of a received signal based upon the results of detection of sheets, it is possible to set the receiving level in the case of presence of sheets and the level of the receiving signal in the case of absence of sheets to virtually the same level, and consequently to easily carry out signal processing and an accurate double feeding determination process.

A length detection means, which detects the length of sheets based upon the results of detection of the sheet detection means, may be further placed, and the double feeding detection means may detect double feeding of sheets based upon the results of detection by the sheet detection means.

The length detection means may be provided as a CPU.

By detecting double feeding of sheets based upon the results of detection of the length of the sheets, it becomes possible to more accurately detect double feeding.

Based upon the level of the ultrasonic waves received by the ultrasonic wave receiving means, the above-mentioned sheet detection means can detect the presence or absence of sheets.

A correction means for correcting the above-mentioned reference phase may be further installed.

Even in the case when the transmission speed of ultrasonic waves is varied due to environmental variations such as temperature and humidity, it is possible to positively detect double feeding by correcting the reference phase.

The correction detection means may be provided as a CPU.

A memory means, which acquires a first initial phase that is a phase of the ultrasonic waves received by the ultrasonic-wave receiving means and that represents an initial state in which no sheet is present in a detection target area and a second initial phase that is a phase of the ultrasonic wave received by the ultrasonic-wave receiving means and that represents an initial state in which a sheet is present in the detection target area, and stores these, or stores the difference between the first initial phase and the second initial phase, is further installed, and the correction means corrects the reference phase based upon the first initial phase and second initial phase stored in the memory means or based upon the difference thereof.

The memory means may be formed by, for example, a computer memory or the like.

The above-mentioned correction means acquires a phase at the time of correction that is the phase of the ultrasonic waves received by the ultrasonic-wave receiving means during the correcting operation when no sheet is in the detection target area, calculates a correction-difference phase that corresponds to a difference component between the phase at the time of correction and the first initial phase stored in the memory means, and corrects said reference phase to a correction reference phase based upon the second initial phase and the correction difference phase stored in the memory means, or corrects the reference phase to a correction reference phase based upon the phase at the time of correction and a difference between the first initial phase and second initial phase stored in the memory means.

The above-mentioned correction means may multiply the component of a difference between the phase at the time of correction and the first initial phase stored in the memory means by a predetermined coefficient so as to calculate the correction difference phase.

Here, the process for calculating the correction difference phase through the multiplication using the coefficient includes processes for preliminarily storing values multiplied by the coefficient in the memory and for reading the corresponding value.

This process makes it possible to carry out a more accurate correction.

The above-mentioned correction means acquires a phase at the time of correction that is the phase of the ultrasonic waves received by the ultrasonic-wave receiving means during the correcting operation in the case of the absence of a sheet in the detection target area, calculates a correction-difference phase that corresponds to a difference component between the second initial phase and first initial phase stored in the memory means, and based upon the phase at the time of correction and the correction-difference phase, corrects the reference phase to the correction reference phase.

This process makes it possible to carry out a more accurate correction.

The correction means may acquire the phase at the time of correction prior to the start of feeding of the sheets.

The correction means may acquire the phase at the time of correction during a period in which the sheets are successively fed, and in the period in which no sheets are present between one of the sheets fed and the next sheet to be fed.

A calculation means, which calculates the average value of phases of the ultrasonic waves received by the ultrasonic-wave receiving means, is further installed, and the correction means corrects the reference phase based upon the average value calculated by the calculation means.

The calculation means may be provided as, for example, a CPU.

By utilizing the average value in this manner, even in the case when it is difficult to detect the phase of an ultrasonic wave accurately, that is, a case in which the environment is gradually varied during feeding processes of sheets with the distance between feeding processes being short without any sheet coming in between, it becomes possible to detect double feeding accurately. With respect to the average value, not only the average value on one sheet, but also the average value on a predetermined number of sheets of not less than two sheets, may be used. The arrangement makes it possible to reduce such cases as to have a great variation in the reference value due to a sudden variation in the phase.

A transporting plate used for feeding the sheets may have an area having a plurality of small pores formed therein through which the ultrasonic waves are transmitted.

By forming many small pores in this manner, it is possible to prevent the ends of the sheets from coming into contact with the hole and causing a feeding error due to warped sheets. Thus, it becomes possible to positively transmit the ultrasonic waves, and consequently to detect double feeding accurately.

A double sheet feeding detecting method of the present invention includes the steps of: detecting a phase difference of the received ultrasonic waves from a reference phase; comparing the phase difference detected by the phase-difference detection step with a preliminarily set predetermined first reference value; counting the number of times in which the phase difference, detected by the phase-difference detection step, exceeds the first reference value based upon the results of comparison obtained by the comparison processes; and detecting double feeding of sheets by comparing the counted value calculated by the counting step with a second reference value that has been preliminarily set and based upon the results of comparison.

In accordance with this double sheet feeding detecting method, it is possible to obtain the same effects as those obtained by the double sheet feeding detector.

A first program of the present invention, which is a program for controlling a double sheet feeding detector which applies ultrasonic waves onto a transporting path of sheets and receives the applied ultrasonic waves to detect a double feeding of sheets, includes program modules which allow a computer to execute the steps of: detecting a phase difference of the received ultrasonic waves from a reference phase; comparing the phase difference detected by the phase-difference detection step with a preliminarily set predetermined first reference value; counting the number of times in which the phase difference, detected by the phase-difference detection step, exceeds the first reference value based upon the results of comparison obtained by the comparison processes; and detecting a double feeding of sheets by comparing the counted value calculated by the counting step with a second reference value that has been preliminarily set and based upon the results of comparison.

In this case, the respective steps are composed of the same steps disclosed in embodiments of the double sheet feeding detecting method.

Then, by using this program, it also becomes possible to achieve a double sheet feeding detector that can positively detect the double feeding of sheets.

A second double sheet feeding detector of the present invention includes ultrasonic wave generation means for generating ultrasonic waves to be applied to a feeding path for sheets; ultrasonic wave receiving means for receiving ultrasonic waves generated by the ultrasonic wave generation means; phase detection means which detects a phase of the ultrasonic waves received by the ultrasonic wave receiving means; varying amount detection means which detects the varying amount of the phase detected by the phase detection means; accumulation means which accumulates the varying amounts detected by the varying amount detection means; comparison means which compares the varying amount accumulated by the accumulation means with a predetermined reference value preliminarily set; and double feeding detection means which detects double feeding of the sheet based upon the results of comparison of the comparison means.

In this case, the relationship between the ultrasonic wave generation means for sheets and the ultrasonic wave receiving means in embodiments is the same as that of the first double sheet feeding detector.

The phase difference detection means may be provided as, for example, a CPU.

The varying amount detection means may be provided as, for example, a CPU which executes a process for calculating the difference between the phase detected last time and the phase detected this time.

The accumulation means may be provided as, for example, a CPU which carries out a process for adding the varying amount of this time to the current varying amount.

The comparison means may be provided as, for example, a CPU. The double feeding detection means may be provided as, for example, a CPU.

In the second double sheet feeding detector of the present invention, the varying amount of the phase of the received ultrasonic waves is detected, and detection is carried out on a double feeding based upon the results of comparison between the accumulated varying amount and the reference value.

Therefore, it becomes possible to positively detect double feeding independent of the thickness of the sheets. Moreover, it is not necessary to set parameters, etc. so as to detect double feeding, and consequently improves operability.

The number of times of detection per unit time by the varying amount detection means may be altered in accordance with the feeding speed or the size of sheets.

In the comparison means, it is possible to alter the reference value in accordance with the feeding speed or the size of the sheets.

This reference value may be decreased when the feeding speed of the sheets is small, while it may be increased when the feeding speed of the sheets is great.

The setting of the reference value in this manner makes it possible to more accurately detect double feeding.

A speed control means controls the feeding speed of sheets at the time of a double feeding determination so as to be slower than determinations other than double feeding.

A level detection means, which detects the level of a received ultrasonic wave by the above-mentioned ultrasonic wave receiving means, is further installed; thus, the double feeding detection means can detect double feeding of sheets independent of the results of phase detection by the phase detection means in the case when the level detected by the level detection means is smaller than a predetermined reference value.

By detecting double feeding of sheets utilizing the results of detection by the level detection means, it becomes possible to more positively detect double feeding.

Moreover, a sheet detection means, which detects the presence or absence of sheets by utilizing the level of a received signal, may be further installed.

The sheet detection means is formed by, for example, a level determining unit.

A level control means, which controls the level of a signal received by the receiving means based upon the results of detection by the sheet detection means, may be further installed.

The level control means is constituted by, for example, analog switches and resistors.

By controlling the received signal level based upon the results of the detection of the sheets, it becomes possible to process the level of received signals at virtually the same levels as in the cases of the presence of sheets and the absence thereof, and consequently to detect double feeding more accurately.

A length detection means, which detects the length of sheets based upon the results of detection by sheet detection means, may be further provided so that the double feeding detection means is allowed to detect double feeding of sheets based upon the results of detection by the length detection means.

The length detection means is provided as, for example, a CPU.

By further detecting double feeding of sheets based upon the results of detection by the length detection means, it becomes possible to more positively detect double feeding.

The above-mentioned sheet detection means may detect the presence or absence of sheets based upon the level of the received ultrasonic waves by the ultrasonic wave receiving means.

A second double sheet feeding detection method of the present invention includes the steps of: detecting the phase of a received ultrasonic wave; detecting a varying amount of the phase detected by the phase detection step; accumulating the varying amounts detected by the varying amount detection step; comparing the varying amount accumulated by the accumulation step with a predetermined reference value preliminarily set; and detecting double feeding of sheets based upon the results of comparison of the comparison step.

The ultrasonic wave generation step and the ultrasonic wave receiving step are constituted by, for example, processes in which an oscillation amplifier controls an ultrasonic wave transmitter and a process for receiving the generated ultrasonic waves by an ultrasonic wave receiver.

In the second double sheet feeding detection method also, it is possible to obtain the same effects as those obtained in the second double sheet feeding detector.

A second program of the present invention, which is a program for a double sheet feeding detector which applies ultrasonic waves onto a transporting path of sheets and receives the applied ultrasonic waves to detect double feeding of sheets, includes program modules which allow a computer to execute the steps of: detecting the phase of a received ultrasonic wave; detecting a varying amount of the phase detected by the phase detection step; accumulating the varying amounts detected by the varying amount detection step; comparing the varying amount accumulated by the accumulation step with a predetermined reference value preliminarily set; and detecting a double feeding of the sheet based upon the results of comparison of the comparison step.

The phase detection step, the varying amount detection step, the accumulation step, the comparison step and the double feeding detection step of this embodiment correspond to the respective steps in the second double sheet feeding detection method of the present invention.

By using this program also, it becomes possible to achieve a double sheet feeding detector that can positively detect a double feeding of sheets independent of the thickness of sheets.

BRIEF DESCRIPTION OF THE DRAWINGS

FIG. 1 is a block diagram that shows a construction of a printing system to which the present invention is applied.

FIG. 2 is a block diagram that shows a construction of a level determining unit of FIG. 1.

FIGS. 3A–3D are drawings that explain the principle of double feeding detection by using a phase of an ultrasonic wave.

FIG. 4 is a flow chart that explains the processes of the system shown in FIG. 1.

FIG. 5 is a flow chart that explains another operation of the system shown in FIG. 1.

FIG. 6 is a timing chart that shows a motor clock synchronous signal and timing in sampling.

FIG. 7 is a timing chart that shows a motor clock synchronous signal and timing in sampling.

FIG. 8 is a flow chart that shows still another operation of the system shown in FIG. 1. FIG. 9 is a drawing that explains the directional property of the reference value.

FIG. 10 is a flow chart that explains still another operation of the system shown in FIG. 1.

FIG. 11 is a flow chart that explains still another operation of the system shown in FIG. 1.

FIG. 12 is a flow chart that explains still another operation of the system shown in FIG. 1.

FIG. 13 is a flow chart that explains still another operation of the system shown in FIG. 1.

FIG. 14 is a flow chart that explains a determining process which is combined with another process in the system of FIG. 1.

FIGS. 15A–15F are drawings that explain influences due to environmental variations on ultrasonic waves.

FIG. 16 is a flow chart that explains an initial data acquiring process in the system shown in FIG. 1.

FIG. 17 is a flow chart that explains an acquiring process of a reference phase after correction in the system shown in FIG. 1.

FIG. 18 is a flow chart that explains another initial data acquiring process in the system shown in FIG. 1.

FIG. 19 is a flow chart that explains another acquiring process of a reference phase after correction in the system shown in FIG. 1.

FIG. 20 is a flow chart that explains another operation of the system shown in FIG. 1.

FIG. 21 is a flow chart that explains still another operation of the system shown in FIG. 1.

FIG. 22 is a timing chart that explains a correcting process in a phase having no paper in a paper-to-paper gap.

FIG. 23 is a flow chart that explains processes in which the correction is used in a phase having no paper in a paper-to-paper gap.

FIG. 24 is a drawing that explains the relationship between the phase difference of a receiving wave to a transmission wave in the case of no paper and the phase difference thereof in the case of a sheet of paper being located.

FIG. 25 is a flow chart that explains another process in which the correction is used in a phase having no paper in a paper-to-paper gap.

FIG. 26 is a timing chart that corresponds to the process shown in FIG. 25.

FIG. 27 is a drawing that explains an averaging process on the phase.

FIG. 28 is a flow chart that explains still another operation of the system shown in FIG. 1

FIG. 29 is a timing chart that explains a process corresponding to a flow chart of FIG. 28.

FIG. 30 is a flow chart that explains still another operation of the system shown in FIG. 1.

FIG. 31 is a flow chart that explains the operation of the system shown in FIG. 1.

FIG. 32 is a flow chart that explains still another operation of the system shown in FIG. 1.

FIG. 33 is a plan view that explains a hole through which an ultrasonic wave is transmitted.

FIG. 34 is a side view that explains a hole through which an ultrasonic wave is transmitted.

DETAILED DESCRIPTION OF THE INVENTION

FIG. 1 shows a structural example that represents a printing system to which the present invention is applied. In this structural example, various settings are carried out by a personal computer (PC) 1 so as to control a printer 2.

A motor driver 24 of the printer 2 drives and rotates a motor 25. The rotation of the motor 25 is transmitted to a feeding roller 27 through a belt 26, and the rotation of the feeding roller 27 is further transmitted to a feeding roller 28 through a belt 29. A feeding roller 30 is in press-contact with the feeding roller 27, and a feeding roller 31 is in press-contact with the feeding roller 28. Thus, a sheet of paper 41 sandwiched by the feeding roller 27 and the feeding roller 30 is fed leftward from the right side of FIG. 1 on a feeding plate 32, and further fed leftward while being sandwiched by the feeding roller 28 and the feeding roller 31.

An ultrasonic wave transmitter 61, which is controlled by an oscillation amplifier 73, applies ultrasonic waves onto a feeding path of the sheet of paper 41. An ultrasonic wave receiver 62 receives the ultrasonic wave that has been outputted from the ultrasonic wave transmitter 61, transmitted through the sheet of paper 41, and allowed to pass through a hole 32A formed in the feeding plate 32, and Outputs a receiving signal to an amplifier 74.

A clock signal, generated by an oscillator 72, is supplied to a control block 71, and the control block 71 executes various operations in synchronism with this clock signal.

The control block 71 controls the oscillation amplifier 73 so that the oscillation amplifier 73 drives the ultrasonic wave transmitter 61 so as to generate ultrasonic waves.

The output of the oscillation amplifier 73 is inputted to a filter 91 of the control block 71 through an AD converter 81 so as to be monitored. The filter 91 eliminates a noise component (high-frequency component) from the inputted signal, and outputs the resulting signal to an oscillation peak detecting unit 92. This oscillation peak detecting unit 92 detects the peak value from the inputted signal, and outputs the resulting signal to a processing unit 93.

The amplifier 74 amplifies the output of the ultrasonic wave receiver 62, and outputs the resulting signal to a level determination unit 75. The level determination unit 75 determines the level of the inputted signal from the amplifier 74, and makes a determination that no sheet 41 is present when the level is not less than a reference value, while it makes a determination that the sheet 41 is present when the level is not more than the reference value. When it has been determined that the sheet 41 is present, the level determination unit 75 outputs the detection signal (paper-presence signal) to a processing unit 93. At this time, the level determination unit 75 turns an analog switch 79 off, and turns an analog switch 78 on, thereby inputting the output of the amplifier 74 to an AD converter 80.

Here, when it has been determined that no sheet 41 is present, the level determination unit 75 turns the analog switch 78 off, while it turns the analog switch 79 on, so that, after the output of the amplifier 74 has been voltage-divided (attenuated) by a resistor 76 and a resistor 77, it inputs the resulting signal to the AD converter 80.

A filter 95 eliminates a noise component (high-frequency component) of the inputted signal from the AD converter 80, and outputs the resulting signal to a receiving peak detecting unit 96. The receiving peak detecting unit 96 detects a peak value of the inputted signal from the filter 95, and outputs this to the processing unit 93.

A loop counter 94 carries out a counting operation on a clock supplied from the oscillator 72, and outputs the count value to the processing unit 93. A determination counter 97 counts the number of cases in which the phase difference of the received signal exceeds a threshold value ($\Delta Z$). A data number counter 98 counts the number of samplings.

Supposing that a frequency of a signal that is outputted to the ultrasonic wave transmitter 61 by the oscillation amplifier 73 is f, the frequency of the clock outputted by the oscillator 72 is set to, for example, 360*f*. The AD converters 81, 80 carry out sampling processes by using this frequency 360*f*, and the loop counter 94 counts clocks of this frequency 360*f*.

FIG. 2 represents a structural example of the level determination unit 75. In this structural example, the signal on the receiving side, outputted by the amplifier 74, is inputted to a half-wave rectifier circuit 111, and half-wave rectified. The output of the half-wave rectifier circuit 111 is smoothed by a capacitor 112, and then supplied to a non-inversion input terminal of a comparator 113. A threshold voltage, outputted by a threshold voltage generation unit 114, is supplied to the non-inversion input terminal of the comparator 113. Therefore, when the level of the signal that has been outputted by the half-wave rectifier circuit 111, and smoothed by the capacitor 112 is greater than the threshold voltage outputted by the threshold voltage generation unit 114, the comparator 113 outputs a positive signal (paper-absence signal), and when the level thereof is smaller, it outputs a negative signal (paper-presence signal).

Here, referring to FIG. 3, an explanation will be given of a principle by which double feeding is detected based upon the phase of a receiving signal of an ultrasonic wave.

The level and phase of an ultrasonic wave (the signal by which the oscillation amplifier 73 controls the ultrasonic wave transmitter 61), transmitted by the ultrasonic wave transmitter 61 are shown in FIG. 3A. When the ultrasonic wave transmitter 61 transmits ultrasonic waves having such a phase based upon a control signal from the oscillation amplifier 73, the ultrasonic wave receiver 62 receives the ultrasonic waves, and outputs a receiving signal shown in FIG. 3B or FIG. 3C to the amplifier 74.

FIG. 3B shows the level and the phase of the receiving signal in the case when no sheet 41 is present on the feeding path (on the transmission path of ultrasonic waves), and FIG. 3C shows the level and the phase of the receiving signal in the case when sheet 41 is present on the feeding path. As clearly indicated by comparison between the two signals, the level of the receiving signal is greater in the case of the absence of sheet 41 (FIG. 3B) than that in the case of the presence of sheet 41 (FIG. 3C). Here, the unit of the signal levels shown in FIGS. 3A and 3B is 200 mv/div, while the unit of the signal levels shown in FIG. 3C is 20 mv/div.

Moreover, the phase delay of the receiving signal to the transmission signal in the case of the absence of sheet 41 is θ1 (that is, the phase difference between the peak $P_A$ of the transmission signal shown in FIG. 3A and the peak $P_B$ of the receiving signal shown in FIG. 3B is θ1). In contrast, in the case of the presence of a sheet of paper 41, the phase delay of the receiving signal (FIG. 3C) to the transmission signal (FIG. 3A) is θ2 (that is, the phase difference between the peak $P_C$ of the receiving waves of FIG. 3C and the peak $P_A$ of the transmission waves of FIG. 3A is θ2).

Phase difference θ1 and phase difference θ2 have respectively different values. Moreover, deviations in phase difference θ2 in the case of the presence of one sheet of paper 41 are comparatively small, and located in a range of ±ΔZ with respect to the phase difference θ2.

In contrast, when sheets of paper 41 are superimposed, the phase difference θ is not limited to the range of θ2±ΔZ, and takes a value outside the range. Therefore, it becomes possible to determine whether or not there is a double feeding based upon whether or not the phase difference θ of the receiving signal is located within the reference phase θ2±ΔZ .

Since the determination of double feeding is carried out by utilizing relative variations of the phase of the receiving signal, the base point of the phase of the receiving waves is not limited to this example, and as long as it has a reference waveform having the same frequency as the transmission waves, it is used for finding the phase of the relative receiving waves based upon this as the base point. For example, as shown in FIG. 3D, a reference waveform having the same frequency as the transmission waves (FIG. 3A) is used, and the relative phase θ2' of the receiving waves (FIG. 3C) from the base point (rising edge) may be set as a reference phase. In this case, the phase θ1' at the time of absence of paper is set as a phase from the same base point (rising edge of the reference wave form).

In the present invention, double feeding is basically determined based upon this principle.

Next, referring to the flow chart of FIG. 4, an explanation will be given of a double feeding determining process in the system shown in FIG. 1. Here, the processes in FIG. 4 are basically executed by a CPU 21.

When a personal computer 1 gives an instruction for a printing operation, this CPU 21 controls the oscillation amplifier 73 through the control block 71 so as to output an oscillation control signal to the ultrasonic wave transmitter 61, thereby generating ultrasonic waves. The ultrasonic wave receiver 62 receives the ultrasonic waves outputted by the ultrasonic wave transmitter 61, and outputs a receiving signal to the amplifier 74.

Moreover, the CPU 21 controls the motor driver 24 through a processing unit 93 of the control block 71 to drive the motor 25. The motor 25 is driven to rotate so that the rotation is transmitted to the feeding roller 27 through the belt 26, and the rotation of the feeding roller 27 is transmitted to the feeding roller 28 through the belt 29.

Therefore, a sheet of paper 41 is sandwiched by the feeding roller 27 and the feeding roller 30, and shifted leftward in the figure. The sheet of paper 41 is further sandwiched and shifted leftward by the feeding roller 28 and the feeding roller 31.

Therefore, the ultrasonic waves, outputted by the ultrasonic wave transmitter 61, are directly received by the ultrasonic wave receiver 62 when no sheet 41 is located at a predetermined position on the feeding path (on the transmission path of the ultrasonic waves); however, when paper is located at the predetermined position on the feeding path, an ultrasonic wave transmitted through the sheet of paper 41 is received by the ultrasonic wave receiver 62.

The amplifier 74 amplifies the receiving signal inputted by the ultrasonic wave receiver 62, and outputs the resulting signal to the half-wave rectifier circuit 111 of the level determining unit 75. The half-wave rectifier circuit 111 half-wave-rectifies the inputted receiving signal. The signal, outputted from the half-wave rectifier circuit 111, is smoothed by a capacitor 112, and then inputted to a non-inversion input terminal of a comparator 113.

A threshold voltage, outputted from the threshold voltage generation circuit 114 and supplied to an inversion input terminal of the comparator 113, is set to an intermediate value between the signal level in the case of the absence of a sheet 41 on the feeding path and the signal level in the case of the presence of one sheet located thereon. Therefore, the level of the signal supplied to the non-inversion input terminal of the comparator 113 becomes greater than the threshold voltage when no sheet 41 is present, and becomes smaller than the threshold voltage when sheet 41 is present. Therefore, the comparator 113 outputs a negative signal (paper-presence signal) in the case of presence of sheet 41, and also outputs a positive signal (paper-absence signal) in the case of absence of paper.

The CPU 21 is informed of the receipt of this signal through the processing unit 93. Thus, the CPU 21 is allowed to detect whether or not any sheet 41 has been detected.

At step S1, the CPU21 determines whether or not any sheet 41 (the leading portion thereof) has been detected, and is maintained in a stand-by state until the detection of sheet 41 has been determined. In the case when the presence of sheet 41 has been detected, the sequence proceeds to step S2 where the CPU 21 resets the count value of the determination counter 97 to zero.

A signal used by the oscillation amplifier 73 to control the ultrasonic wave transmitter 61 is AD converted by the AD converter 81. The control block 71 supplies a clock required for this AD conversion to the AD converter 81.

The signal, outputted by the AD converter 81, is inputted to a filter 91, and after noise components (high-frequency components) have been removed, the resulting signal is inputted to the oscillation peak detecting unit 92. Upon detection of the peak value (for example, the peak value $P_A$ of the signal shown in FIG. 3A), the oscillation peak detecting unit 92 informs the CPU 21 of the detection signal through the processing unit 93. Based upon this information, the CPU 21 is allowed to detect whether or not the peak of the transmission waves has been detected.

Here, at step S3, the CPU 21 is maintained in a stand-by state until the peak of the transmission waves has been detected, and upon detection of the peak of the transmission waves, the sequence proceeds to step S4, thereby resetting the value of the loop counter 94 to zero. In other words, this process sets the value of the loop counter 94 to zero at the position of the peak $P_A$ shown in FIG. 3A. The loop counter 94, which always executes the counting operation of clocks outputted by the oscillator 72, is allowed to count the clocks again after having been reset, and increments the count value.

Next, the sequence proceeds to step S5 so that the CPU 21 determines whether or not the peak of the receiving waves has been detected. This determining process is carried out in the following manner.

In other words, when the sheet of paper 41 has not reached the predetermined position on the feeding path, the ultrasonic wave receiver 62 is allowed to directly receive the ultrasonic wave outputted by the ultrasonic wave transmitter 61. In this case, since the level determining unit 75 is outputting the paper-absence signal, as described above, the analog switch 79 is turned on, while the analog switch 78 is turned off. Consequently, the receiving signal outputted from the amplifier 74 is voltage-divided by the resistor 76 and the resistor 77, and after having been attenuated to a predetermined level, is inputted to the AD converter 80 through the analog switch 79.

When the sheet of paper 41 is fed to the predetermined position on the feeding path, the ultrasonic wave receiver 62 receives an ultrasonic wave that has been transmitted through the sheet of paper 41. In this case, since the level determining unit 75 outputs the paper-presence signal, the analog switch 78 is turned on, while the analog switch 79 is turned off. Therefore, in this case, the signal, outputted from the amplifier 74, is inputted to the AD converter 80 (without being voltage-divided by the resistors 76 and 77) through the analog switch 78.

In this manner, in the case when the sheet of paper 41 is not present on the feeding path, since the detection signal outputted by the ultrasonic wave receiver 62 is voltage-divided by the resistor 76 and the resistor 77, and inputted to the AD converter 80; thus, by setting the values of the resistor 76 and the resistor 77 to predetermined values, the signal inputted to the AD converter 80 through the analog switch 78 and the signal inputted thereto through the analog switch 79 are allowed to have signal levels having virtually the same value.

For example, supposing that the output level of the amplifier 74 is 1 when a sheet of paper 41 is present, that it is A when no sheet 41 is present and that the resistance values of the resistor 76 and the resistor 77 are represented by $R_2$ and $R_1$ respectively, when $R_1$ and $R_2$ are set to satisfy the equation $R_1/(R_1+R_2)=1/A$, it is possible to allow the AD converter 80 to always carry out the AD conversion process by using virtually the same dynamic range when any of the signals is received.

Here, the output of the amplifier 74 may be made greater in the case of presence of sheet 41 than in the case of the absence thereof, or the amplifier may be arranged so as to attenuate more in the case of the absence of sheet 41 than that in the case of the presence thereof.

After high-frequency components (noise components) have been removed by the filter 95, the signal, outputted from the AD converter 80, is inputted to the received peak detection unit 96. Upon detection of the peak of the receiving signal, the received peak detection unit 96 informs the CPU 21 of the receipt of the detection signal through the processing unit 93. More specifically, upon detection of the peak $P_B$ shown in FIG. 3B or the peak $P_C$ shown in FIG. 3C, the CPU 21 is informed of the detection signal.

Upon detection of the peak of the receiving signal , the sequence proceeds from step S5 to step S6 so that the CPU 21 sets the count value of the loop counter 94 to a variable θ. Thus, the phase difference from peak $P_A$ to peak $P_B$ in FIG. 3 (in the case of FIG. 3, θ1) is set to the variable θ. Alternatively, the value of the loop counter 94 corresponding to the phase difference of peak $P_A$ to peak $P_C$ is set to θ. When consideration is given based upon the transmitted waves as a reference, this value of θ represents the phase of the receiving waves. Moreover, θ2 represents a reference phase in the case of the presence of one sheet of paper 41.

Next, at step S7, the CPU 21 subtracts the reference phase θ2 from the phase θ of the received signal acquired in step S6, and sets this value to a variable $\theta_0$ serving as the phase difference of the receiving signal.

In other words, this phase difference $\theta_0$ corresponds to the difference between the phase of peak $P_B$ and the reference phase θ2 or the difference between the phase of peak $P_C$ and the reference phase θ2.

Next, at step S8, the CPU 21 determines whether or not the phase difference $\theta_0$ calculated in step S7 is greater than the reference value ΔZ that has been preliminarily set. In other words, as shown in FIG. 3, this reference value ΔZ specifies a predetermined range (the range of±ΔZ) centered on the reference phase θ2.

When the absolute value of the phase difference $\theta_0$ is greater than ΔZ (that is, when the phase θ is smaller than θ2−ΔZ or greater than θ2+ΔZ), the sequence proceeds to step S9 in which the CPU 21 increments the value of the determining counter 97 by 1.

In contrast, when the absolute value of the phase difference $\theta_0$ is equal to ΔZ or smaller than this (that is, when the phase θ is not less than θ2−ΔZ, and also is not more than θ2+ΔZ), the process for incrementing the determining counter 97 at step S9 is skipped.

In other words, with this arrangement, the number of times in which the phase difference $\theta_0$ exceeds the reference range is calculated by the determining counter 97.

Next, the sequence proceeds to step S10 in which the CPU 21 determines whether or not the sheet of paper 41 the presence of which was detected at step S1 has not been detected, that is, whether or not the sheet of paper 41 has passed (whether or not the end portion of the sheet of paper 41 has been detected). When the sheet of paper 41 is still detected (when the end portion of the sheet of paper 41 has not been detected), the sequence returns to step S3, and the processes succeeding this step are executed repeatedly.

Consequently, the same processes are executed repeatedly with one cycle of the ultrasonic waves serving as the process cycle, the phase difference $\theta_0$ of the receiving waves is detected for each cycle, and when the value exceeds the predetermined range ($\theta 2 \pm \Delta Z$), the number of times is counted by the determining counter 97.

At step S10, when it is determined that the sheet of paper 41 is no longer detected (or when the end portion of the sheet of paper 41 has been detected), the sequence proceeds to step S11 in which the CPU 21 determines whether or not the value counted by the determining counter 97 at step S9 is not less than the predetermined threshold value CT. In the case when the count value of the determining counter 97 is not less than the threshold value CT, the sequence proceeds to step S13 in which the CPU 21 carries out a double feeding treatment. In other words, at this time, the CPU 21 controls the motor driver 24 through the processing unit 93 to stop the rotation of the motor 25. Thus, the feeding process of the sheet of paper 41 is suspended.

Moreover, the CPU 21 informs the personal computer 1 of the detection of a double feeding. The personal computer 1 displays this information on the display unit. This display allows the user to know of the occurrence of the double feeding, and the user resumes the printing process after having removed sheet of paper 41 on demand.

In contrast, in the case when the count value of the determining counter 97 is determined to be smaller than the threshold value CT, the sequence proceeds to step S12 so that the CPU 21 executes a single feeding process. In other words, in this case, since no double feeding occurs, the CPU 21 continues the printing process as it is without suspending the printing process.

In this manner, in this example, when the phase difference $\theta_0$ exceeds the predetermined range, this case is not directly determined as a double feeding, and detections are carried out several times within the range of the length of the sheet of paper 41, and as the results of detection, the number of times in which the value of the phase difference $\theta_0$ exceeds the predetermined range is counted, and a double feeding is detected based upon the count value; therefore, since the number of measurements is greater, it becomes possible to positively detect a double feeding even in the case of a thin sheet of paper 41.

Moreover, in contrast, even when the sheet of paper 41 is thick, with the result that the receiving level of the ultrasonic waves is extremely attenuated, a plurality of detection processes is executed as many times as the corresponding cycle of the ultrasonic waves during the period in which the sheet of paper 41 is present; therefore, it becomes possible to positively detect a double feeding.

Moreover, since any specific settings and changes in conditions are not required for determination, it is possible to improve the operability.

The value of the threshold CT that is compared with the count value of the determining counter 97 in the process of step S11, may be set in a manner, for example, as shown by the following equation:

$$CT = CT_R \times (L2/L1) \times (V1/V2)$$

In this case, CTR represents a reference value of the reference threshold CT, L1 is a reference length of a sheet of paper 41 and L2 represents the length of a sheet of paper 41 in the present feeding process. V1 represents a reference feeding speed of the sheet of paper 41, and V2 represents the feeding speed of a sheet of paper 41 in the present feeding process.

Consequently, the value of the threshold CT becomes greater as the length L2 of a sheet of paper 41 becomes longer, and as the value of the feeding speed V2 becomes smaller.

As the length L2 of the sheet of paper 41 becomes longer, the number of samplings of the phase difference $\theta_0$ increases correspondingly. Similarly, as the feeding speed V2 becomes smaller, the number of samplings becomes greater correspondingly. Therefore, in this case, by also making the value of the threshold CT greater, it becomes possible to detect double feeding more accurately.

The length of the feeding sheet of paper 41 may be preliminarily set or may be detected by a detection sensor exclusively prepared for this purpose. Alternatively, the length of the period in which the level determining unit 75 is outputting a paper-presence signal may be calculated based upon the number of clock signals outputted by the oscillator 72, and obtained based upon the following equation.

$$L2 = V2 \times (t2 - t1)$$

Here, t1 in the above-mentioned equation represents the time (clock number) at which the leading end of the sheet of paper 41 is detected, and t2 represents the time (clock number) at which the rear end portion of the sheet of paper 41 is detected. Moreover, the feeding speed V2 can be detected from the rotation speed of the motor 25.

Furthermore, in the case when the feeding speed of the sheet of paper 41 is too fast to detect a double feeding accurately, the CPU 21 controls the motor 25 through the motor driver 24 so that, during a period (determining period of a double feeding) in which at least the sheet of paper 41 is being transported through a position (a position of a hole 32A of the feeding plate 32) at which the ultrasonic transmitter 61 and the ultrasonic receiver 62 are aligned face to face with each other, the sheet of paper 41 may be driven at a slower speed in comparison with the speed during the other periods. In this case, upon completion of the double feeding determination process (after the passage through the hole 32A), the sheet of paper 41 is fed at a faster feeding speed.

In the example of FIG. 4, the phase is detected every time the peak of a transmission wave is detected; however, the intervals of these samplings (detections) may be changed in response to the size of the sheet of paper 41 and the feeding speed of the sheet of paper 41.

For example, supposing that the frequency of an ultrasonic wave is 40 kHz, when the phase is detected with respect to each peak detection of the transmission waves, it is possible to obtain phase data at the rate of 40000 times per second.

Here, it is supposed that the number of samplings required for the determination of a sheet of paper 41 having a length of 100 mm is 400. In this case, for example, supposing that the feeding speed of the sheet of paper 41 is 100 mm/sec., it is possible to obtain 40000 sampling values from a sampling period from the start of the end of the sheet of paper 41 having the length of 100 mm. Therefore, samplings are not always carried out every time the peak value is detected, and even in the case when samplings are carried out at a rate of once every 100 times, it is possible to obtain 400 sampling values.

Moreover, in the case when, supposing that the feeding speed is 10 mm/sec, samplings are carried out every time the peak is detected from the start of the sheet of paper 41 to the end thereof, it is possible to obtain 4000×10 sampling values. Therefore, in this case, in order to obtain 400 sampling values, it is possible to carry out samplings once every 1000 times.

The following description will discuss how to represent the above-mentioned facts in equations. In other words, when it is supposed that the number of samplings (data amount) required for detecting a sheet of paper 41 having a length L of the sheet of paper 41 is D, that the frequency of ultrasonic waves is F, and that the feeding speed is V, the sheet of paper 41 having length L is fed for a period of time represented by L/V (sec.); therefore, during this period, D sampling times are required. Thus, the number of samplings required for one second is represented by: $D/(L/V)=(D\times V)/L$, and it is assumed that the samplings can be carried out once every $F/((D\times V)/L)=(F\times L)/(D\times V)$ times.

FIG. 5 shows an example of the processes carried out in this case. The processes of steps S31 to S46 are basically the same processes as those of steps S1 to S13 in FIG. 4; however, in the example of FIG. 5, in the case when a sheet of paper 41 has been detected in the process of step S31, the value of the determining counter 97 is reset at step S32, and at step S33, the value D of the data number counter 98 is reset.

Next, at step S34, the sequence is maintained in a stand-by state until the peak of the transmission waves has been detected, and upon detection of the peak of the transmission waves, the sequence proceeds to step S35 in which only the value D of the data number counter 98, which has been reset in the process at step S33, is incremented by 1. Then, at step S36, it has been determined whether or not the value D has become equal to a preliminarily set specific value, and if it is not equal, the sequence returns to step S34 in which the sequence is again maintained in the stand-by state until the next peak detection of the transmission waves.

As described above, each time the peak of the transmission waves has been detected, the value D of the data number counter 98 is incremented, and when it is determined that the value D has reached the specified value at step S36, the sequence proceeds to step S37 in which the counter of the loop counter 94 is reset, and at step S38, the sequence is maintained in the stand-by state until the detection of a peak of the receiving waves.

Upon detection of the peak of the receiving waves, at step S39, the value of the loop counter 94 is set to a variable θ, and at step S40, the difference between the value of θ and the value of the reference phase θ2 is set as the phase difference $\theta_0$.

At step S41, it has been determined whether or not the value of the phase difference $\theta_0$ exceeds the reference value ΔZ, and when lit exceeds the reference value, the sequence proceeds to step S42 in which the value of determining counter 97 is incremented. When the value of the phase difference $\theta_0$ has not exceeded the reference value ΔZ, the value of the determining counter 97 is not incremented.

At step S43, it is determined whether or not the sheet of paper 41 has passed, and if it has not passed, the sequence returns to step S34, and the processes succeeding thereto are executed repeatedly.

At step S43, if it is determined that the sheet of paper 41 has passed, the sequence proceeds to step S44, where it is determined whether or not the value of the determining counter 97 is not less than the threshold CT. If the value of determining counter 97 is not less than the threshold, a double feeding treatment is carried out at step S46, while, if this is less than the threshold, the single feeding process is executed at step S45.

As described earlier, the cycle of samplings is calculated based upon $(F\times L)/(D\times V)$; however, in order to carry out this calculation, it is necessary to preliminarily obtain the feeding speed V. Moreover, even if this is preliminarily known, it becomes difficult to find an accurate sampling period in such a case in which the feeding speed V is varied in the middle of the process.

Therefore, the sampling operation may be carried out in synchronism with a motor clock synchronous signal for driving the motor 25 for feeding the sheet of paper 41. In this case, as shown in FIG. 1, the motor clock synchronous signal, which is used by the motor driver 24 to drive the motor 25, is supplied to the CPU 21 through the processing unit 93.

As shown in FIGS. 6 and 7, in synchronism with the rising edge of the motor clock synchronous signal (FIG. 6A or FIG. 7A), the CPU 21 detects the peak of the transmission waves that succeeds immediately after the rising edge (FIG. 6B or FIG. 7B).

With this arrangement, for example, as shown in FIG. 6, in both of the cases when the cycle of the motor clock synchronous signal (FIG. 6A) becomes longer, and in contrast, as shown in FIG. 7, when the cycle thereof becomes shorter, since the feeding amount of the sheet of paper 41 is made synchronous to the motor clock synchronous signal, it is possible to always ensure a constant sampling cycle independent of variations in the feeding speed as long as the length of the sheet of paper 41 is constant.

A flow chart in FIG. 8 shows double feeding detection processes in this case. The processes at steps S51 to S67 are basically the same processes as steps S31 to S46 in FIG. 5; however, between step S53 and step S55 of FIG. 8 that correspond to processes of steps S33 and S34, the process of step S54 is inserted, in the flow chart of FIG. 8.

At step S54, after the value of the data number counter D has been reset at step S53, the stand-by process up to the detection of the rising edge of the motor clock synchronous signal (FIG. 6A, FIG. 7A) is executed. Upon detection of the rising edge of the motor clock synchronous signal (FIGS. 6A and 7A), the CPU 21 allows the sequence to proceed to step S55 so as to execute the peak detection process of the transmission waves.

The other processes are carried out in the same manner as shown in the flow chart of FIG. 5.

In this manner, by executing the processes shown in the flow chart in FIG. 8, the peak detection process of transmission wave is carried out so that the sheet of paper 41 is always fed by a fixed distance (in synchronism with the motor clock synchronous signal). Consequently, even when the feeding speed of the sheet of paper 41 is varied in the middle of the feeding process, the value of the counter D is always set to a constant value as long as the length of the sheet of paper 41 is constant.

In the above description, with respect to the reference phase θ2 in FIG. 3, both of the threshold values in the range in the negative direction (in the left direction of the figure) and in the range in the positive direction (in the right direction of the figure) are represented by ΔZ, that is, the same value; however, for example, as shown in FIG. 9, with respect to the reference phase θ2, the value ΔZ1 that specifies the range in the negative direction and ΔZ2 that specifies the range in the positive direction may be set to different values. As to which value is set to a greater value, it is determined depending on characteristics of each apparatus.

Processes in this case are shown in the flow chart of FIG. 10. The processes of step S71 to step S83 in the flow chart of FIG. 10 are basically the same as the processes of step S1 to step S13 of FIG. 4; however, in the process of step S78 in FIG. 10 that corresponds to the process of step S8 of FIG. 4, it is determined whether or not the phase difference $\theta_0$ is greater than ΔZ2 (whether the phase θ is greater than θ2+ΔZ2) or smaller than −ΔZ1 (whether the phase θ is smaller than θ2−ΔZ1). When the phase difference $\theta_0$ is greater than ΔZ2 or smaller than −ΔZ1, the count value of the determining counter 97 is counted up at step S79. In contrast, when the phase difference $\theta_0$ is equal to −ΔZ1 or greater than this, and is equal to ΔZ2 or smaller than this (when the phase θ is not less than θ2−ΔZ1 and not more than θ2+ΔZ2), the count-up process of the determining counter 97 is not executed.

The other processes are the same as those shown in FIG. 4.

With respect to the direction of deviation from the reference phase θ2 in each apparatus, each apparatus may have a predetermined tendency. In this case, the range in the direction having a higher tendency of deviation is made wider so that it becomes possible to carry out a double feeding determination more accurately.

In the above description, double feeding is detected based upon the number of times in which the phase exceeds the threshold; however double feeding may be detected based upon the varying amount of the phase. FIG. 11 shows a process example for this case.

In the processes shown in FIG. 11, at step S91, the CPU 21 is maintained in a stand-by state until a sheet of paper 41 has been detected, and upon detection of a sheet of paper 41, the sequence proceeds to step S92 in which the value of a counter MC (not shown) for accumulating the varying amount is initially set to zero. Moreover, the CPU 21 sets the value of the reference phase in the case of a feeding process of one sheet of paper 41 as variable PN. More specifically, the value of θ2 in FIG. 3 is set.

Next, at step S93, the CPU 21 is maintained in a stand-by state until the peak of a transmission wave has been detected, and upon detection of the peak, the sequence proceeds to step S94 in which the value of the loop counter 94 is reset.

Moreover, at step S95, the CPU 21 is maintained in the stand-by state until the peak of a transmission wave has been detected, and upon detection of the peak of the transmission waves, and at step S96, the count value of the loop counter 94 at that time is set as the variable θ.

Next, at step S97, the CPU 21 updates the value of the counter MC for accumulating the varying amount based upon the following equation.

$$MC=MC+|\theta-PN|$$

$$PN=\theta$$

In this case, since θ2 is set as the variable PN, the difference between the phase θ of the receiving waves and the reference phase θ2, detected at step S76, is added to the counter MC.

Next, the sequence proceeds to step S98 in which the CPU 21 determines whether or not the sheet of paper 41 is no longer detected, and if it is still detected, the sequence returns to step S93, and the processes after this step are executed repeatedly.

In other words, as described above, the difference between the present phase and the previous phase is successively accumulated in the varying amount accumulation counter MC as the varying amount of the phase for each cycle of the ultrasonic waves.

When, at step S98, it is determined that the sheet of paper 41 is no longer detected (or when the end portion of the sheet of paper 41 is detected), the sequence proceeds to step S99 in which the CPU 21 determines whether or not the value of the varying amount accumulation counter MC calculated in the process of step S97 exceeds the preliminarily set specific threshold value R. When the value of the varying amount accumulation counter MC is not less than the threshold R, the sequence proceeds to step S101, and the CPU 21 carries out a double feeding treatment. In contrast, when it is determined that the value of the varying amount accumulation counter MC is smaller than the threshold R, the sequence proceeds to step S100 so that the CPU 21 carries out a single feeding process.

As described above, in this example, the varying amount of the phase is sampled several times, and by comparing the accumulated value with the threshold R, the double feeding is detected; therefore, in the same manner as the above-mentioned cases, it is possible to positively detect a double feeding.

Here, the value of the threshold R in step S99 of FIG. 11 may also be changed by using the following equation based upon the feeding speed V2 and the length L2 of a sheet of paper, in the same manner as the value of the threshold CT at step S11 in FIG. 4.

$$R=R_0\times(L2/L1)\times(V1/V2).$$

In this case, $R_0$ represents a reference value of the threshold R.

In this manner, the threshold R may be appropriately altered based upon the feeding speed V or the size of the sheet of paper so that it is possible to carry out the double feeding detection process more accurately.

In the process shown in FIG. 11 also, in the same manner as the process in FIG. 8, the number of samplings may be changed in accordance with the length of a sheet of paper 41 or the feeding speed. FIG. 12 shows a process example in this case.

The processes of steps S111 to S124 of FIG. 12 are basically the same as those of steps S91 to steps S101 in FIG. 11.

Here, in the process at step S112 corresponding to step S92 in FIG. 11, the value of the varying amount accumulation counter MC is reset, and after the reference phase in the case of the presence of one sheet of paper 41 has been set as the variable PN, the value D of the data number counter 98 is reset at step S113.

Then, at step S114, the sequence is maintained in a stand-by state until the peak of a transmission wave has been detected, and upon detection of the peak of the transmission wave, the value D of the data number counter 98, which has been reset in the process at step S113, is incremented only by 1 at step S115. Next, at step S116, it is determined whether or not the value D of the data number counter 98 becomes equal to the preliminarily set specified value, and if this is not equal thereto, the sequence returns to step S114, and the sequence is maintained in the stand-by state until the next peak of the transmission waves has been detected.

The above-mentioned processes are executed repeatedly at step S116 until it is determined that the value D of the data number counter 98 has reached the specified value. In other words, the sampling of the varying amount detection is executed not every time the peak of the transmission waves has been detected, but once every number of times equal to the specified value.

When, at step S116, it is determined that the value D of the data number counter 98 has reached the specified value, the sequence proceeds to step S117 in which the value of the loop counter 94 is reset. The succeeding processes of step S118 to S124 are the same as the processes of step S95 to step S101 shown in FIG. 11.

In the above-mentioned process examples, double feeding is detected based upon the number of times in which the phase exceeds the threshold value or upon the varying amount of the phase exceeds the threshold; however, another double feeding detection method based upon another principle may be combined therewith.

FIG. 13 shows an example of this case. The processes of step S131 to step S144 in FIG. 13 are basically the same as those of step S1 to step S13 in FIG. 4.

Here, in the example of FIG. 13, when it is determined that sheets of paper 41 no longer are present in the process of step S140 corresponding to step S10 of FIG. 4, it is determined whether or not the detection level of the receiving signal is not less than the reference value at step S141. When the detection level of the receiving signal is smaller than the reference value, the sequence proceeds to step S144 in which a double feeding treatment is carried out independent of the value of the determining counter. In contrast, in the case when the detection level of the receiving signal is not less than the reference value, the double feeding treatment or the single feeding process is carried out based upon the results of comparison of the value of the determining counter 97 and the threshold value CT, in the same manner as those shown in FIG. 4.

The other processes are carried out in the same manner as those shown in FIG. 4.

As described above, in the example shown in FIG. 13, it is determined whether or not the level of the receiving signal is not less than the reference value. For example, in the case of a double feeding of a number of sheets 41, the level of the receiving signal is extremely attenuated. When the level of the receiving signal becomes extremely small as a result, it is assumed that, even when the count value of the determining counter 97 is smaller than the threshold CT, an accurate detection is not available; therefore, this case is determined as a double feeding.

In contrast, when, although the level of the receiving signal is attenuated, it is still not less than the reference level, it is determined that no double feeding is occurring on the assumption that an accurate detection is available.

In this manner, it is possible to carry out double feeding detection more accurately.

Here, with respect to the level detection of the receiving signal, the output of the half-wave rectifying circuit 111 of FIG. 2, as it is, may be supplied to the CPU 21 through the processing unit 93 so as to carry out the detecting process.

Moreover, such a process in which the double feeding determination based upon the level of the receiving signal is used in combination may also be carried out in processes shown in FIGS. 11 and 12.

In addition, the double feeding detection process based upon the length of sheets of paper 41, as shown in the flow chart of FIG. 14, may be used in combination with the above-mentioned double feeding detection process.

In other words, in the process example of FIG. 14 at step S151, the CPU 21 makes a determination as to whether or not the leading end portion of a sheet of paper 41 has been detected based upon the output of the comparator 113 in the level determining unit 75. Then, when it is determined that the leading end portion of the sheet of paper 41 has been detected, the CPU 21 allows the sequence to proceed to step S152 in which the value of the loop counter 94 is set as the variable C1.

Next, the sequence proceeds to step C153, and the CPU 21 is maintained in the stand-by state until the rear end portion of a sheet of paper 41 has been detected based upon the output of the comparator 113, and upon detection of the rear end portion of the sheet of paper 41, the sequence proceeds to step S154, and the value of the loop counter 94 at that time is set as the variable C2. At step S155, the CPU 21 subtracts the value of the variable C1 set at step S152 from the value of the variable C2 set at step S154, and sets the resulting value as the variable C. The value of the variable C is equivalent to the number of clock signals that corresponds to the length from the leading end portion to the rear end portion of the sheet of paper 41.

Therefore, at step S156, the CPU 21 compares the value of the variable C calculated in the process at step S155 with the preliminarily set specific reference value $C_0$, and if the value of the variable C is equal to the reference value $C_0$ or greater than this, a double feeding treatment is carried out at step S158, while, if the value of the variable C is smaller than the reference value $C_0$, a single feeding process is carried out at step S157.

With respect to the double feeding determination process based upon the length of the sheet of paper, when all of the sheets of paper 41 are superimposed on each other, it is not possible to carry out a double feeding detection; however, when only some portions thereof are superimposed, it is possible to positively carry out a double feeding detection since the length to be detected is longer than the length of one sheet.

As described above, by combining the determining process based upon the length of the sheet of paper with another process, it becomes possible to more positively detect a double feeding.

Here, ultrasonic wave vary in their transmission speed depending on variations in the environment such as temperature, humidity and atmospheric pressure. This fact means that, when ultrasonic waves are used to detect double feeding, the detection results differ depending on the environmental variations. In order to suppress the reduction in detection precision due to the environmental variations, it is possible to carry out correcting processes as will be described below.

FIGS. 15A to 15C show the phase relationship among a transmission wave (FIG. 15A) generated by the ultrasonic wave transmitter 61 during the reference time (initial stage), a receiving wave (FIG. 15B) in the case of the absence of sheet 41 and a receiving wave (FIG. 15C) in the case when one sheet of paper 41 is present. These FIGS. 15A to 15C respectively correspond to FIGS. 3A to FIG. 3C in the above-mentioned FIG. 3. Here, in FIGS. 15A to 15C, the levels of the respective signals are defined as the same levels, for convenience of explanation.

In other words, as explained by reference to FIG. 3, in the case of the absence of a sheet of paper 41, the phase delay of the receiving waves to the transmission waves is θ1, while the phase delay in the case of the presence of one sheet of paper 41 becomes θ2. This phase delay θ2 is permitted to deviate by ΔZ1 in the negative direction and ΔZ2 in the positive direction.

FIGS. 15D to 15F respectively represent a transmission wave (FIG. 15D) in the case of the varied environment, a receiving wave (FIG. 15E) in the case of the absence of a sheet of paper 41, a receiving wave (FIG. 15F) in the case of the presence of one sheet of paper 41. The transmission wave of FIG. 15D is set to have the same phase as the transmission wave of FIG. 15A. As shown in FIG. 15E, when the phase of the receiving waves in the case of the absence of a sheet of paper 41 is varied by θt so that the phase difference to the transmission waves becomes θ1+θt, the phase of the receiving waves in the case of the presence of one sheet of paper 41 is also varied by θt so that the phase difference to the transmission waves becomes θ2+θt. In the present invention, by utilizing this principle, the correcting process of the reference phase is carried out.

First, the user gives an instruction to the CPU 21 through the personal computer 1 so as to execute an initial data acquiring process shown in a flow chart of FIG. 16, and the corresponding process is carried out. Here, this process may be carried out preliminarily by the manufacturer of the printer 2.

At step S171, the CPU 21 acquires the phase difference θ1 of the receiving waves from the transmission waves in the case of the absence of a sheet of paper 41, and supplies this to the memory 22 as an initial phase θ1L to be stored therein.

Next, at step S172, the CPU 21 acquires the phase difference θ2 of the receiving waves from the transmission waves in the case of the presence of one sheet of paper 41, and supplies this to the memory 22 as an initial phase θ2L to be stored therein.

In other words, the phases of the receiving signals in the initial state, shown in FIG. 15B and FIG. 15C, are preliminarily stored.

Next, in predetermined timing (for example, immediately before the start of a printing process by the printer 2), the user allows processes shown in the flow chart of FIG. 17 to be carried out.

First, at step S181, the CPU 21 acquires the phase difference θ1 of the receiving waves from the transmission waves in the case of the absence of a sheet of paper 41 as the phase θ1*f* at the time of correction.

Next, at step S182, the CPU 21 reads the initial phase θ1L stored in the memory 22 in the process of step S171 (FIG. 16). Moreover, at step S183, the CPU 21 reads the initial phase θ2L stored in the memory 22 in the process of step S172 (FIG. 16).

At step S184, the CPU 21 carries out calculations in which the initial phase θ1L read from the memory 22 at step S182 is subtracted from the phase θ1*f* at the time of correction acquired at step S181, that is, calculations based upon the following equation, to obtain Δθ1.

$$\Delta\theta 1=\theta 1f-\theta 1L$$

Next, the sequence proceeds to step S185, and the CPU 21 adds the calculated value Δθ1 obtained in the process at step S184 to the initial phase θ2L read in the process at step S183 so that the reference phase θ2B is calculated based upon the following equation, and stored in the memory 22.

$$\theta 2B=\theta 2L+\Delta\theta 1$$

The calculated value Δθ1, obtained through the calculation in the process at step S184, corresponds to the value θt shown in FIG. 15D. Therefore, the reference phase θ2B corresponds to θ2+θt shown in FIG. 15D.

The processes of the above-mentioned FIGS. 16 and 17 may be substituted by processes shown in FIGS. 18 and 19.

In other words, in the processes of FIG. 18 that correspond to the process of FIG. 16, the CPU 21 acquires the phase difference θ1 of the receiving waves from the transmission waves in the case of the absence of a sheet of paper 41 as the initial phase θ1L, at step S191.

At step S192, the CPU 21 acquires the phase difference θ2 of the receiving waves to the transmission waves in the case of the presence of one sheet of paper 41 as the initial phase θ2L.

Then, at step S193, the CPU 21 carries out calculations in which the initial phase θ1L acquired at step S191 is subtracted from the initial phase θ2L obtained at step S192, that is, calculations based upon the following equation, to obtain its difference ΔθL, and supplies this to the memory 22 to be stored therein.

$$\Delta\theta L=\theta 2L-\theta 1L$$

Moreover, in the process at FIG. 19 corresponding to FIG. 17, at step S201, the CPU 21 acquires the phase difference θ1 of the receiving waves from the transmission waves in the case of the absence of a sheet of paper 41 as the phase θ1*f* at the time of correction.

At step S202, the CPU 21 reads ΔθL stored in the memory 22 in the process at step S193 of FIG. 18.

At step S203, the CPU 21 carries out calculations in which ΔθL read at step S202 is added to θ1*f* at the time of correction obtained at step S201, that is, calculations based upon the following equation, to obtain the reference phase θ2B.

$$\theta 2B=\theta 1f-\Delta\theta L$$

The value of the reference phase θ2B (=θ1f+ΔθL=θ1*f*+ΔθL2−θL1), obtained at this step S203, is equal to the value of the reference phase θ2B (=θ2L+Δθ1=θ2L+θ1*f*−θ1L=θ1*f*+θL2−θL1) obtained in the process at step S185 shown in FIG. 17.

As described above, when the reference phase θ2B in the environment immediately before the printing process has been stored in the memory 22, the CPU 21 starts the printing process. Then, a sheet of paper 41 is fed, and each time a printing process is carried out, processes shown in the flow chart of FIG. 20 are executed.

The processes carried out at steps S211 to S223 of FIG. 20 are basically the same processes as the aforementioned processes of steps S1 to S13 shown in FIG. 4.

However, in the process at step S217 corresponding to step S7 of FIG. 4, the reference phase θ2B, which has been calculated at step S185 of FIG. 17 or step S203 of FIG. 19, and stored in the memory 22, is used in place of θ2 so as to calculate the following equation.

$$\theta_0=\theta-\theta 2B$$

Then, at the process of step S218 corresponding to, step S8 of FIG. 4, it is determined whether or not the value $\theta_0$ calculated in the process at step S217 is smaller than−ΔZ1, or whether or not the value $\theta_0$ is greater than ΔZ2. In the case when the value $\theta_0$ is smaller than−ΔZ1 or greater than ΔZ2, the count value of the determining counter 97 is incremented at step S219.

The other processes are the same as those shown in FIG. 4; therefore, the repetitive description thereof is omitted.

In other words, in the process of FIG. 4, θ2 is used as the reference phase; however, in the processes shown in FIG. 20, the reference phase θ2B after the correction is used. Consequently, it becomes possible to reduce improper operations due to variations in the environment.

FIG. 21 shows another process example. The processes at step 231 to step 243 are basically the same as those of step S211 to step S223 shown in FIG. 20; however, step S220 of FIG. 20, which carries out a determining process as to whether or not a sheet of paper has passed, is executed before the determining process of step S221 as to whether or not the determining counter value is not less than the threshold CT in the process example of FIG. 20. However, in the process example of FIG. 21, this process is carried out as the process of step S243 after the single feeding process at step S241 or the double feeding treatment of step S242. The other processes are the same as those shown in FIG. 20.

In this case also, the same effects as those obtained in FIG. 20 can be achieved.

In the above-mentioned embodiments, the reference phase θ2B is measured in the environment immediately before the start of the printing process; however, as shown in FIG. 22, the reference phase θ2B may be calculated during a period between the feeding process of one sheet of paper 41 and the next feeding process of another sheet of paper 41

In the example of FIG. 22, during period T11 prior to period T12 during which one sheet of paper 41 is fed, there is a period (paper-to-paper period) in which no sheet of paper 41 is present. In the same manner, during period T21 succeeding to period T12, there is a period (paper-to-paper period) in which no sheet of paper 41 is present, and thereafter, during period T22, the next sheet of paper 41 is fed. Thereafter, a paper-to-paper period again is present during period T31.

The phase of the receiving signal during the period (paper-to-paper period) in which no sheet of paper 41 is present, such as periods T11, T21 and T31, is obtained as θ1*g*. In the example of FIG. 22, phases, θ1*g*1, θ1*g*2, θ1*g*3, are respectively obtained in association with periods T11, T21 and T31.

During period T11, the initial phase θ1L is subtracted from this phase θ1*g*1 to calculate the phase difference Δθ11. In the same manner, during period T21, the initial phase θ1L is subtracted from this phase θ1*g*2 to calculate the phase difference Δθ12.

The reference phase θ2B1 during period T12 immediately after period T11 is calculated by the following equation based upon the phase difference Δθ11 calculated during period T11 immediately before period 12.

$$\theta 2B1=\theta 2L+\Delta\theta 11$$

In the same manner, during period T22, the reference phase θ2B2, which is calculated from the following equation based upon the phase difference Δθ12 during period T21 immediately before, is used.

$$\theta 2B2=\theta 2L+\Delta\theta 12$$

The results of the above-mentioned processes are shown in FIG. 23.

In other words, at step S251, the CPU 21 obtains the phase θ1g (in the case of the absence of a sheet of paper 41) in the paper-to-paper period (for example, period T11).

Next, at step S252, the CPU 21 calculates the reference phase θ2B based upon the following equation.

$$\theta 2B=\theta 2L+\Delta\theta 1=2L+(\theta 1g-\theta 1L)$$

Next, at step S253, a determining process of double feeding is carried out. This determining process is, for example, a determining process shown in FIG. 20 or FIG. 21.

Next, at step S254, it is determined whether or not the feeding process of a sheet of paper 41 has been completed, and if it is determined that the feeding process of the sheet of paper 41 has not been completed, the CPU 21 allows the sequence to return to step S251 so that the processes succeeding to this step are repeatedly executed. In other words, in the process of the next step S253, θ2B, obtained by calculations in step S252 during the paper-to-paper period immediately before, is used as the value of θ2B of step S217 of FIG. 20 or step S237 of FIG. 21.

When, at step S254, it is determined that the feeding process of the sheet of paper 41 has been completed, the entire process is completed.

In this manner, in the process examples of FIG. 22 and FIG. 23, the reference phase θ2B is calculated each time a sheet of paper 41 is fed sheet by sheet; therefore, it is possible to properly deal with abrupt variations in the environment.

Here, in the above-mentioned correction processes, when the phase difference θ1 of the receiving waves from the transmission waves in the case of the absence of a sheet of paper 41 is varied by θt, the phase difference θ2 of the receiving waves to the transmission waves in the case of the presence of one sheet of paper 41 is varied in accordance with a straight line L1 in FIG. 24, that is, in proportion to the variation, and this is used as the premise of the above-mentioned correction processes.

For example, it is assumed that, supposing that the phase of the receiving waves in the case of the absence of a sheet of paper 41 is varied by θt due to variations in the environment to change the phase difference to the transmission waves to θ1+θt, the phase of the receiving waves in the case of the presence of one sheet of paper 41 is also varied by θt to change the phase difference to the transmission waves to θ2+θt.

However, more specifically, supposing that the phase of the receiving waves in the case of the absence of a sheet of paper 41 is varied by θt due to variations in the environment to change the phase difference to the transmission waves to θ1+θt, the phase of the receiving waves in the case of the presence of one sheet of paper 41 is varied by k□θt in accordance with a straight line L2 of FIG. 24 to change the phase difference to the transmission waves to θ2+k·θt.

Supposing that, when the phase difference θ1 is varied by θt, the phase difference θ2 is varied by k□θt, for example, in the process at step S184 in FIG. 17, after calculations have been carried out based upon the following equation:

$$\Delta\theta 1=\theta 1f-\theta 1L,$$

the resulting value, Δθ1, is further multiplied by the preset coefficient k. Then, in the process at step S185, the reference phase θ2B is calculated by the following equation:

$$\theta 2B=\theta 2L+k\cdot\Delta\theta 1.$$

In the same manner, for example, in the process at step S252 of FIG. 23, the reference phase θ2B is calculated based upon the following equation:

$$\theta 2B=\theta 2L+k\cdot\Delta\theta 1=\theta 2L+k(\theta 1g-1L)$$

By carrying out the above-mentioned processes, it becomes possible to accurately detect the phase difference, that is, a double feeding.

Here, with respect to the process for multiplying by the coefficient k, the corresponding calculations may be actually made, or the corresponding values multiplied by the coefficient k may be preliminarily stored in the memory 22, and these may be read on demand. The value of the coefficient k is set to a value other than 1.

The equation, θ2B=θ2L+(θ1g+θ1L) at step S252 in FIG. 23, may be rewritten in the following manner:

$$\theta 2B=\theta 1g+(\theta 2L-\theta 1L)$$

Therefore, the difference between the initial phase θ2L and θ1L is preliminarily calculated as ΔθL as indicated by the following equation, and stored in the memory 22; thus, in place of the processes shown in a flow chart in FIG. 23, it is possible to carry out processes shown in a flow chart in FIG. 25.

$$\Delta\theta L=\theta 2L-\theta 1L$$

The processes at steps S261 to S264 in FIG. 25 are basically the same processes as those at steps S251 to S254 in FIG. 23. However, at step S262 in FIG. 25 that corresponds step S252 in FIG. 23, θ2B is calculated by the following equation.

$$\theta 2B=\theta 1g+\Delta\theta L=\theta 1g+(\theta 2L-\theta 1L)$$

As clearly shown by comparison between the process at step S262 and the process at step S252 in FIG. 23, the two equations are mathematically equivalent to each other, and this shows that the same processes are virtually carried out.

When the processes shown in FIG. 25 are developed in terms of time, they are given as shown in FIG. 26.

In other words, as indicated by the following equation, the phase difference ΔθL is added to the phase θ1g1 detected in period T11 to find the reference phase θ2B2 during period T12.

$$\theta 2B1=\theta 1g1+\Delta\theta L$$

In the same manner, as indicated by the following equation, the phase difference ΔθL is added to the phase θ1g2 detected in period T21 to find the reference phase θ2B2 during period T22 immediately after period T21.

$$\theta 2B2=\theta 1g2+\Delta\theta L$$

Here, the value of the phase θ2 obtained by the sampling is not always a uniformed value. In other words, for example, as schematically shown in FIG. 27, the value of θ2 is varied every sampling process. Therefore, during the period in which one sheet of paper 41 is present, the obtained sampling values are averaged, and the average value may be utilized in the double feeding determination process in the feeding process of the next sheet of paper 41.

FIG. 28 shows a process example in this case. The processes at steps S361 to S369 are basically the same as those at steps S211 to S219 in FIG. 20. However, in the process example in FIG. 28, at step S369, when the number of times in which the phase θ exceeds the threshold is counted by the determining counter 97, the phase θ (the value of the loop counter 94 detected in the process at step S366) at that time is stored in the memory 22 at step S370.

When, at step S368, it is determined that the value of $\theta_0$ has not exceeded the threshold, the count-up process of the determining counter 97 at step S369 and the storing process of the phase θ at step S370 are skipped.

Then, at step S371, it is determined whether or not a sheet of paper 41 has passed, and if the sheet of paper 41 has not passed, the sequence returns to step S363, and the processes after this step are executed repeatedly.

When, at step S371, it is determined that the sheet of paper 41 has passed (the rear end portion of the sheet of paper 41 is detected), the sequence proceeds to step S372, and the CPU 21 makes a determination as to whether or not the value of the determining counter 97 that has counted-up in the process at step S369 is not less than the threshold CT. If the count value of the determining counter 97 is not less than the threshold CT, the sequence proceeds to step S373, and the double feeding treatment is carried out.

When, at step S372, it is determined that the value of the determining counter 97 is not more than the threshold CT, the sequence proceeds to step S374, and the CPU 21 calculates the average value θav of the values of the phase θ which have been stored at step S370 and have been sampled with respect to the sheet of paper 41. Then, at step S375, the CPU 21 sets the average value θav calculated at step S374 as the value of the reference phase θ2B.

In this manner, when the reference phase θ2B is set based upon the average value θav of the phase values of one sheet of paper 41, the corresponding value is used as the reference phase θ2B at step S367 in the double feeding determining process of the next sheet of paper 41.

The other processes are the same as those in FIG. 20.

In other words, in the example of FIG. 28, as shown in FIG. 29, based upon the average value θav 1 of the phase θ2 during period T21, the phase reference θ2B2 during feeding period T22 of the next sheet of paper 41 is set. Then, based upon the average value θav 2 of the phase θ2 in period T22, the reference phase θ2B3 during the next period T23 is set.

In this manner, by setting the phase reference of the next sheet of paper 41 based upon the average value of the results of detection of the previous sheet of paper 41, even in the case when the environment during a feeding process of a sheet of paper 41 gradually changes, and when the paper-to-paper length is short so that the phase is not accurately acquired when no sheet 41 is located between the paper-to-paper length, it is possible to prevent cases in which the reference phase is subjected to serious influences due to sudden variations in the phase.

Here, in the process example of FIG. 28, the determining process as to whether or not the sheet of paper has passed at step S371 may be inserted after the determining process as to whether or not the count value of the determining counter 97 is not less than the threshold CT, as shown in FIG. 30.

In other words, the processes at steps S391 to S405 in FIG. 30 are basically the same as those processes at steps S361 to S375 of FIG. 28; however, the determining process at step S371 in FIG. 28 is carried out at step S403 in the example of FIG. 30 in the case when it is determined that the determining counter value of step S401 does not exceed the threshold CT. When, at step S403, it is determined that the sheet of paper 41 no longer is present, the process for calculating the average value θav at steps S404 and S405 corresponding to steps S374 and S375 of FIG. 28 and the process for setting the results of calculation to the reference phase θ2B are carried out.

The other processes are the same as those shown in FIG. 28.

In the processes shown in a flow chart of FIG. 20, with respect to the case in which the value of the variable $\theta_0$ is smaller than−ΔZ1 or greater than ΔZ2, the number of times (the value of the determining counter 97) over the entire range of the sheet of paper 41 is compared with the threshold CT so that a determination is made as to whether or not a double feeding occurs. However, in this case, since the number of samplings becomes greater as the length of a sheet of paper 41 becomes longer, the value of the determining counter 97 becomes greater, resulting in a possibility of an erroneous determination of a double feeding in the case of a long sheet of paper 41.

Therefore, the determining counter 97 is allowed to count the number of times in which the condition that the value of the variable $\theta_0$ is smaller than−ΔZ1 or greater than ΔZ2 (hereinafter, referred to as double feeding determining condition) is continuously satisfied is counted by the determining counter 97; thus, a case in which the number of times in which the double feeding determining condition is continuously satisfied becomes not less than the predetermined threshold CTS may be determined as a double feeding.

FIG. 31 shows a process example in this case. The processes at steps S411 to S424 of FIG. 31 are basically the same as those processes at steps S211 to S223 in FIG. 20; however, in processes in FIG. 31, in the case when it is determined that the value of the variable $\theta_0$ is smaller than—ΔZ1 or greater than ΔZ2 (that is, when it is determined that the double feeding determining condition is satisfied) at step S418 corresponding to step S218 of FIG. 20, the value of the determining counter 97 is incremented at step S419. When it is determined at step S418 that the double feeding determining condition is not satisfied, the value of the determining counter 97 is reset to zero at step S420. With this process, the number of times in which the double feeding determining condition is continuously satisfied is counted by the determining counter 97.

After the process at step S419 or step S420, at step S421, it is determined whether or not the value of the determining counter 97 is not less than the predetermined threshold CTS, and if it is not less than the threshold value CTS, a double feeding treatment is carried out at step S422.

In contrast, when it is determined at step S421 that the value of the determining counter 97 is smaller than the threshold CTS, it is determined whether or not the sheet of paper 41 has passed at step S423, and when the sheet of paper 41 has not passed, the sequence returns to step S413, and the processes after this step are executed repeatedly.

When it is determined at step S423 that the sheet of paper 41 has passed, a single feeding process is executed at step S424.

The other processes are the same as those in FIG. 20.

With this process, it becomes possible to prevent an increase in the possibility of erroneous determinations as the length of sheet of paper 41 increases.

In order to obtain the same effects, in the process as shown in the flow chart of FIG. 30, the number of times in which the double feeding determining condition is continuously satisfied may be counted by the determining counter 97. FIG. 32 shows a process example in this case.

The processes at steps S441 to S456 in FIG. 32 are basically the same as those processes at steps S391 to S405 in FIG. 30. However, at step S448 in FIG. 32 that corresponds to step S398 in FIG. 30, when it is determined that the double feeding determining condition is satisfied, the value of the determining counter 97 is incremented at step S449, and at step S450, the value of θ is further stored. In contrast, when it is determined at step S448 that the double feeding determining condition is not satisfied, the value of the determining counter 97 is reset to zero at step S451.

With this process, the number of times in which the double feeding determining condition is continuously satisfied is counted by the determining counter 97. Then, after the process of step S450 or step S451, at step S452, it is determined whether or not the value of the determining counter is not less than the preliminarily set threshold CTS, and if it is not less than the threshold CTS, at step S453, a double feeding treatment is carried out.

In contrast, when it is determined at step S452 that the value of the determining counter 97 is smaller than the threshold CTS, it is determined whether or not the sheet of paper 41 has passed at step S454, and if it has not passed, the sequence returns to step S443, and the processes after this step are executed repeatedly.

When it is determined at step S454 that the sheet of paper 41 no longer is present, the average value θav of stored θ is calculated at step S455. Then, at step S456, the value of the reference phase θ2B is set to the average value θav calculated at step S455.

The other processes are the same as those shown in FIG. 30.

In the same manner as the process shown in FIG. 31, this process also makes it possible to prevent an increase in the possibility of erroneous determinations as the length of sheet of paper 41 increases.

In the example of FIG. 1, as shown in FIG. 33A, a big hole (having a diameter of, for example, 15 mm) 32A is formed in the feeding plate 32 so as to allow ultrasonic waves to pass through, and as shown in FIG. 33B, this hole may be provided as a number of small holes 32B. For example, as shown in FIG. 34, the formation of a number of small holes 32B makes it possible to eliminate the problem in which, when a sheet of paper 41 is fed on the feeding plate 32, the end portion of the sheet of paper 41 is stuck in the hole 32B, causing a difficulty in smoothly feeding the sheet of paper 41.

It is most preferable for the feeding process of a sheet of paper 41 not to form the holes 32A, 32B in the feeding plate 32; however, without these, the transmission of ultrasonic waves will be difficult. Therefore, it is preferable to form a number of holes 32B so as to allow ultrasonic waves to pass easily, and to achieve a smooth feeding process of a sheet of paper 41.

Here, in the above-mentioned examples, the processes shown in the respective flow charts are executed by software using a CPU 21 shown in FIG. 1; however, of course, hardware may be provided and the respective processes may be carried out by using the hardware.

The above explanations have dealt with examples in which the present invention is applied to a printing machine; however, the present invention may be applied to cases such as copying machines and scanners in which paper, sheets or the like is fed, and double feeding has to be detected.

In the case when the above-mentioned sequence of processes is carried out by software, a program forming the software is installed in a computer having an exclusively-used hardware or a general-use personal computer capable of carrying out various functions, through a network and a recording medium.

Here, in the present specification, the step for describing a program to be recorded in a recording medium includes not only processes that are carried out in a time-sequential manner in accordance with the order that is described, but also processes to be executed in parallel with each other or in a discrete manner, even if these are not executed in a time-sequential manner.

As described above, the double sheet feeding detector, a method and a program for such a device of the present invention, it becomes possible to easily detect the double feeding of sheets.

What is claimed is:

1. A double sheet feeding detector comprising:

ultrasonic wave generation means for generating ultrasonic wave to be applied to a feeding path for sheets;

ultrasonic wave receiving means for receiving ultrasonic waves generated by said ultrasonic wave generation means;

phase-difference detection means for detecting a phase difference between a phase of said ultrasonic waves received by said ultrasonic wave receiving means and a predetermined reference phase;

comparison means for comparing said phase difference detected by said phase-difference detection means with a preliminarily set first reference value;

counting means for counting the number of times in which said phase difference detected by said phase-difference detection means exceeds said first reference value based upon results of comparison of said comparison means; and double feeding detection means for comparing a calculated value counted by the counting means with a second, preliminarily set reference value and detects a double feeding of sheets based upon the comparison of the calculated value with the second reference value.

2. The double sheet feeding detector according to claim 1 wherein said comparison means compares at least either a third reference value serving as a reference with respect to a deviation of said phase difference in a positive direction or a fourth reference value serving as a reference with respect to a deviation in a negative direction and having an absolute value different from said third reference value.

3. The double sheet feeding detector according to claim 1 or 2, wherein said double feeding detection means alters said second reference value depending on a transfer speed or sizes of said sheets.

4. The double sheet feeding detector according to claim 1 or 2, wherein the number of counts by said counting means per unit time is altered depending on a transfer speed or sizes of said sheets.

5. The double sheet feeding detector according to claim 1, further comprising:

transport means for transporting sheets onto said feeding path, wherein said phase-difference detection means detects the phase difference of said ultrasonic waves from said reference phase in synchronism with a signal synchronizing to the amount of transfer of sheets by said transfer means.

6. The double sheet feeding detector according to claim 1, further comprising:

speed control means for controlling the transfer speed of said sheets at the time of double feeding determination so as to be slower than at times of determinations other than double feeding.

7. The double sheet feeding detector according to claim 1, further comprising:

level detection means for detecting a level of said ultrasonic waves received by said ultrasonic wave receiving means, wherein, when the level of said ultrasonic waves is smaller than a reference value based upon the results of detection made by said level detection means, said double feeding detection means detects this case as a double feeding of said sheets independent of values of said counted value.

8. The double sheet feeding detector according to claim 1, further comprising:

sheet detection means for detecting the presence or absence of said sheets; and level control means which controls the level of said signal received by said ultrasonic wave receiving means based upon the results of detection by said sheet detection means.

9. The bouble sheet feeeding detector according to claim 1, wherein a transporting plate, used for feeding said sheets, has an area having a plurality of small pores formed therein through which said ultrasonic waves are transmitted.

10. The double sheet feeding detector according to claim 1, further comprising:

sheet detection means for detecting the presence or absence of said sheets; and length detection means for detecting lengths of said sheets based upon the results of detection by said sheet detection means, wherein said double feeding detection means detects double feeding of said sheets based upon the results of detection by said length detection means.

11. The double sheet feeding detector according to claim 8 or 10, wherein said sheet detection means detects the presence or absence of said sheets based upon the level of said ultrasonic waves received by said ultrasonic wave receiving means.

12. The double sheet feeding detector according to claim 1, further comprising:

correction means for correcting said reference phase.

13. The double sheet feeding detector according to claim 12, further comprising:

calculation means for calculating an average value of phases of said ultrasonic waves received by said ultrasonic-wave receiving means for at least one sheet of said sheets, wherein said correction means corrects said reference phase based upon said average value calculated by said calculation means.

14. The double sheet feeding detector according to claim 11, further comprising:

memory means for acquiring a first initial phase that is a phase of said ultrasonic wave received by said ultrasonic-wave receiving means and that represents an initial state in which no sheets are present and a second initial phase that is a phase of said ultrasonic waves received by said ultrasonic-wave receiving means and that represents an initial state in which a sheet is present, and stores the difference between said first initial phase and said second initial phase, wherein said correction means corrects said reference phase based upon said first initial phase and second initial phase stored in said memory means.

15. The double sheet feeding detector according to claim 14, wherein said correction means acquires a phase at the time of correction that is the phase of said ultrasonic waves received by said ultrasonic-wave receiving means during the correcting operation in the case of no sheet, calculates a correction-difference phase that corresponds to a difference component between said second initial phase and said first initial phase stored in said memory means, and based upon said phase at the time of correction and said correction-difference phase, corrects said reference phase to said correction reference phase.

16. The double sheet feeding detector according to claim 14, wherein said correction means acquires a phase at the time of correction that is the phase of said ultrasonic waves received by said ultrasonic-wave receiving means during the correcting operation in the case of no sheet, calculates a correction-difference phase that corresponds to a difference component between said phase at the time of correction and said first initial phase stored in said storing means, and corrects said reference phase to a correction reference phase based upon said second initial phase and said correction difference phase stored in the memory means or corrects said reference phase to a correction reference phase based upon said phase at the time of correction and a difference between said first initial phase and said second initial phase stored in said memory means.

17. The double sheet feeding detector according to claim 16, wherein said correction means calculates said correction difference phase by multiplying a difference component between said phase at the time of correction and said first initial phase stored in said memory means by a predetermined coefficient.

18. The double sheet feeding detector according to claim 16, wherein said correction means acquires said phase at the time of correction prior to the start of feeding of said sheets.

19. The double sheet feeding detector according to claim 16, wherein said correction means acquires said phase at the time of correction during a period in which said plurality of sheets are successively fed, and in the period in which no sheets exist between one of said sheets that has already been fed and the next sheet to be fed.

20. A double sheet feeding detecting method of a double sheet feeding detector which applies ultrasonic waves onto a transporting path of sheets and receives the applied ultrasonic waves to detect a double feeding of sheets, comprising:

detecting a phase difference of said received ultrasonic waves from a reference phase;

comparing said phase difference with a preliminarily set predetermined first reference value;

counting the number of times in which said phase difference exceeds said first reference value based upon the results of comparison; and detecting said double feeding of said sheets by comparing the counted value calculated by said counting step with a second reference value that has been preliminarily set.

21. A program for controlling a double sheet feeding detector which applies ultrasonic waves onto a transporting path of sheets and receives the applied ultrasonic waves to detect a double feeding of said sheets, said program comprising modules allowing a computer to execute the steps of:

detecting a phase difference of said received ultrasonic waves from a reference phase;

comparing said phase difference with a preliminarily set predetermined first reference value;

counting the number of times in which said phase difference exceeds said first reference value; and detecting a double feeding of said sheets by comparing the counted value calculated by said counting step with a second reference value that has been preliminarily set.

22. A double sheet feeding detector comprising:

ultrasonic wave generation means for generating ultrasonic waves to be applied to a feeding path for sheets;

ultrasonic wave receiving means for receiving said ultrasonic waves generated by said ultrasonic wave generation means;

phase detection means for detecting a phase of said ultrasonic waves received by said ultrasonic wave receiving means;

varying amount detection means for detecting the varying amount of said phase detected by said phase detection means;

accumulation means for accumulating said varying amounts detected by said varying amount detection means;

comparison means for comparing said varying amounts accumulated by said accumulation means with a predetermined reference value preliminarily set; and double feeding detection means for detecting a double feeding of said sheets based upon the results of comparison of said comparison means.

23. The double sheet feeding detector according to claim 22, wherein said varying amount detection means alters the number of detections per unit time depending on a transporting speed or a size of said sheets.

24. The double sheet feeding detector according to claim 23, further comprising:

speed control means for controlling the transporting speed of said sheets at the time of the double feeding determination so as to be slower than at times of determinations other than double feeding.

25. The double sheet feeding detector according to claim 22 or 23, wherein said comparison means alters said reference value depending on the transporting speed or the size of said sheets.

26. The double sheet feeding detector according to claim 22, further comprising:

level detection means for detecting the level of said ultrasonic waves received by said ultrasonic wave receiving means, wherein, when the level detected by said level detection means is smaller than a predetermined reference value, said double feeding detection means detects a double feeding of said sheets independent of the results of phase detection by said phase detection means.

27. The double sheet feeding detector according to claim 22, further comprising:

sheet detection means for detecting the absence or presence of said sheets; and level control means for controlling the level of said signal received by said ultrasonic wave receiving means based upon the results of detection by said double feeding detection means.

28. The double sheet feeding detector according to claim 22, further comprising:

sheet detection means for detecting the absence or presence of said sheets; and length detection means for detecting a length of said sheets based upon the results of detection by said sheet detection means, wherein said double feeding detection means detects a double feeding of said sheets based upon the results of detection by the length detection means.

29. The double sheet feeding detector according to claim 27 or 28, wherein said sheet detection means detects the presence or absence of said sheets based upon the level of said received ultrasonic waves by said ultrasonic wave receiving means.

30. A double sheet feeding detecting method carried out within a double sheet feeding detector which applies ultrasonic waves onto a transporting path of sheets and receives the applied ultrasonic waves to detect a double feeding of said sheets, comprising:

detecting a phase of said received ultrasonic waves;

detecting a varying amount of said phase;

accumulating said varying amounts;

comparing said varying amounts with a predetermined reference value preliminarily set; and detecting a double feeding of said sheets based upon the results of comparison of said comparing.

31. A program for a double sheet feeding detector which applies ultrasonic waves onto a transporting path of sheets and receives the applied ultrasonic waves to detect a double feeding of said sheets, said program comprising modules allowing a computer to execute the steps of:

detecting a phase of a received ultrasonic wave;

detecting a varying amount of said phase;

accumulating said varying amounts;

comparing said varying amounts with a predetermined reference value preliminarily set; and detecting a double feeding of said sheet based upon the results of comparison of said comparing.

* * * * *